US005213942A

United States Patent [19]

Deguchi et al.

[11] Patent Number: 5,213,942

[45] Date of Patent: May 25, 1993

[54] SILVER HALIDE COLOR REVERSAL PHOTOGRAPHIC MATERIAL HAVING SILVER HALIDE EMULSIONS WITH DIFFERENT GRAIN DIAMETERS

[75] Inventors: Naoyasu Deguchi; Shigeo Hirano; Yasuhiro Hayashi, all of Minami-ashigara, Japan

[73] Assignee: Fuji Photo Film Co., Ltd., Kanagawa, Japan

[21] Appl. No.: 715,740

[22] Filed: Jun. 18, 1991

Related U.S. Application Data

[63] Continuation of Ser. No. 286,795, Dec. 20, 1988, abandoned.

[30] Foreign Application Priority Data

Dec. 22, 1987 [JP] Japan ..... 62-324567

[51] Int. Cl.[5] ..... G03C 1/295

[52] U.S. Cl. ..... 430/218; 430/379; 430/567; 430/571; 430/578; 430/955

[58] Field of Search ..... 430/557, 571–598, 430/379, 268, 217, 955

[56] References Cited

U.S. PATENT DOCUMENTS

| | | | |
|---|---|---|---|
| 3,942,986 | 3/1976 | Florens | 430/567 |
| 4,444,874 | 4/1984 | Silverman et al. | 430/598 |
| 4,554,245 | 11/1985 | Hayashi et al. | 430/567 |
| 4,639,410 | 1/1987 | Mochizuki et al. | 430/567 |
| 4,724,199 | 2/1988 | Kobayashi et al. | 430/564 |
| 4,746,601 | 5/1988 | Mihayashi et al. | 430/567 |
| 4,770,982 | 9/1988 | Ichijima et al. | 430/595 |
| 4,770,990 | 9/1988 | Nakamura et al. | 430/564 |
| 4,912,028 | 3/1990 | Vannaule | 430/564 |

FOREIGN PATENT DOCUMENTS

| | | | |
|---|---|---|---|
| 0074548 | 4/1984 | Japan | 430/567 |
| 2031846 | 2/1987 | Japan | 430/567 |
| 2229129 | 10/1987 | Japan | 430/567 |

*Primary Examiner*—Lee C. Wright

*Attorney, Agent, or Firm*—Birch, Stewart, Kolasch & Birch

[57] ABSTRACT

The present invention relates to a silver halide color reversal photographic material comprising photosensitive silver halide photographic layers in which the average silver chloride content of the photosensitive silver halide emulsions is less than 7.0 mol %, at least one emulsion layer of the photographic layers consists of two or more emulsions having different average grain diameters, and the emulsion layer and/or the adjacent intermediate layer contains at least one compound that can release a photographically useful agent by redox reaction with the oxidation product of a developing agent. The silver halide color reversal photographic material of the present invention has a color-reversed image improved in graininess and sensitivity.

15 Claims, No Drawings

SILVER HALIDE COLOR REVERSAL PHOTOGRAPHIC MATERIAL HAVING SILVER HALIDE EMULSIONS WITH DIFFERENT GRAIN DIAMETERS

This application is a continuation of application Ser. No. 07/286,795 filed on Dec. 20, 1988, now abandoned.

FIELD OF THE INVENTION

The present invention relates to a silver halide color reversal photographic material high in sensitivity and excellent in graininess.

BACKGROUND OF THE INVENTION

In recent years, silver halide color reversal photographic materials have been increasingly required to have high image quality, that is, to have the quality improved in many respects, including not only sensitivity, but also image structure, such as graininess and sharpness, color reproduction, and tone reproduction.

Among other aspects, the improvement of graininess has become very important because formats of photographic materials including films are now being made smaller, and much research has been conducted to improve graininess.

For example, in JP-A ("JP-A" means unexamined published Japanese patent application) No. 178235/1982, a high-speed silver halide photographic material excellent in graininess is disclosed wherein two or more monodisperse emulsions are present in one layer so that the grain diameter distribution curve may have two or more maximums (peaks), and the interval between the first highest maximum mode and the second highest maximum mode may be 0.3 μm or over. However, according to research by the present inventors, this method did not satisfactorily and simultaneously improve graininess and attain high sensitivity.

In order to render the contrast and the sensitivity of a silver halide photographic material high, JP-A No. 107029/1985 discloses a technique wherein at least one layer of a silver halide photographic material contains a compound that will release a fogging agent under alkaline conditions by a redox reaction with the oxidation product of a developing agent when the photographic material is developed. However, although this technique very effectively renders high sensitivity of a photographic material, it is inclined to deteriorate the graininess a little.

In order to improve graininess, JP-A No. 158435/1985 discloses a technique wherein a silver halide photographic material contains silver halide grains such that at least 20 % of the total projected areas of the silver halide grains of at least one layer contain silver halide grains of average diameter, corresponding to the projected areas, 0.5 μm or below, and at least 20 % of the total projected areas of the silver halide photographic material contain silver halide grains of average diameter, corresponding to the projected areas, 0.7 μm or over, and the silver halide photographic material includes a compound that will release a fogging agent or a development accelerator, or their precursor, corresponding to the developed silver quantity when the silver halide photographic material is developed, so that the graininess is improved without increasing the fog.

However, the technique described in JP-A No. 158435/1985 mentioned above had the problem that if the technique was applied to a silver halide color reversal photographic material that would give a color-reversed image, the desired high sensitivity and improvement of graininess could not been attained.

SUMMARY OF THE INVENTION

The first object of the present invention is therefore to provide a silver halide color reversal photographic material for forming a color-reversed image improved in graininess.

The second object of the present invention is to provide a silver halide color reversal photographic material that is highly sensitized without allowing the graininess of the color-reversed image to be impaired.

Other and further objects, features, and advantages of the invention will appear more fully from the following description.

DETAILED DESCRIPTION OF THE INVENTION

The objects of the present invention have been attained by a silver halide color reversal photographic material wherein photosensitive silver halide photographic layers in which the average silver iodide content of the photosensitive silver halide emulsions is less than 7.0 mol % are formed on a base, at least one emulsion layer of said photographic layers comprises two or more emulsions having different average grain diameters in the range of 0.05 to 3.0 μm, the grain diameter distribution curve of the silver halide grains has two or more maximums, and the grain diameter difference of the lowest maximum and the next lowest maximum is 0.1 μm or over, and said emulsion layer and/or an adjacent intermediate layer contains at least one compound that can release a photographically useful agent such as fogging agent, development accelerator, or silver halide solvent, or their precursor, corresponding to the developed silver quantity by a redox reaction with the oxidation product of a developing agent, or by a reaction subsequent to such redox reaction.

In the present invention, the average silver iodide content of the photosensitive silver halide photographic layers formed on a base is generally less than 7.0 mol %, preferably in the range of 1.0 to 6.5 mol %, and more preferably 1.5 to 6.0 mol %. Herein, by "photographic layers" is meant applied layers that comprise photosensitive silver halide emulsion layers different in spectral sensitivity and through which a developing solution can pass from one to the other, thereby contributing to the formation of a color photographic image, and photographic layers include a protective layer and an intermediate layer but not a backing layer.

The development processing of the color reversal photographic material comprises a black-and-white development step→a reversal step (or a step of fogging by light)→a color development step→a conditioning step→a bleaching step→a fixing step→a washing step→and a stabilizing step. The developing solution in said black-and-white development step generally contains a large amount of a silver halide solvent, and although the color reversal photographic material is developed while the silver halides therein are being dissolved, when the silver iodide content of the silver halides of the emulsion exceeds 7 mol %, the silver halides hardly become dissolved in said black-and-white development step, and therefore the progress of the development becomes slow, which means that the intended increase in sensitivity and improvement of graininess are not attained.

In the present invention the grain diameter distribution curve of at least one layer of the photosensitive silver halide photographic layers has two or more maximums, said layer consists of photosensitive silver halide emulsion grains wherein the grain diameter difference between the maximum whose grain diameter is the smallest and the maximum whose grain diameter is the next smallest is 0.1 μm or over. The photosensitive silver halide emulsion grains may be composed of two or more polydisperse emulsions having different grain diameters, and preferably at least one monodisperse emulsion, and the silver halide emulsion whose average grain diameter is smallest more preferably is a monodisperse emulsion, and most preferably is composed of monodisperse emulsions whose average grain diameters are different.

Herein, by "average grain diameter" is meant the average value of the diameters of silver halide grains when they are spherical, or the average value of the diameters calculated as circles having the same areas as those of the projected images when silver halide grains are cubic or in a shape other than spherical, or the average value of the diameters calculated as spheres having the same volumes as those of the particular silver halide grains when the silver halide grains are tabular, and the average grain diameter r is defined by the following formula:

$$\bar{r} = \frac{\Sigma niri}{\Sigma ni}$$

wherein ri represents the diameters of the individual grains and ni is the number of grains having the same diameter ri.

In the present invention the average grain diameter of the silver halide emulsion of at least one layer of the photosensitive silver halide emulsion layers is 0.05 to 3.0 μm. When the average grain diameter is smaller than 0.05 μm, the particular grains are liable to dissolve during the development processing, and improvement of the graininess cannot be observed, while if the average grain diameter exceeds 3.0 μm, the graininess becomes poor. The average grain diameter of the silver halide emulsion in the present invention is preferably in the range of 0.1 to 2.5 μm, more preferably 0.15 to 2.0 μm. It is preferable that the grain diameter difference between the smallest grain diameter maximum and the next smallest grain diameter maximum among two or more maximums of the grain diameter distribution curve in the present invention is in the range of 0.15 to 1.0 μm.

By "monodisperse emulsion" is meant such an emulsion that when the standard deviation s defined by the following formula:

$$s = \sqrt{\frac{\Sigma(\bar{r} - ri)^2 ni^2}{\Sigma ni}}$$

is divided by the average grain diameter r given above, the value is 0.20 or below.

$$\frac{s}{\bar{r}} \leqq 0.20$$

Hereinafter, $s/\bar{r} \times 100$ is referred to as the deviation coefficient (%).

The redox compound (hereinafter referred to as FR compound) that is used in the present invention and that can release a fogging agent or a development accelerator (hereinafter referred to as "FA"), or their precursor, corresponding to the developed silver quantity by a redox reaction with the oxidation product of a developing agent, or by a reaction subsequent to such redox reaction, can be represented by the formula (I):

$$RED-(TIME)_n-FA \qquad \text{Formula (I)}$$

wherein

RED represents a compound residue able to cause a redox reaction with the oxidation product of a developing agent, $-(TIME)_n-FA$ is linked to a position where it can be released from RED by a redox reaction with the oxidation product of a developing agent, or by a reaction subsequent to such redox reaction, TIME represents a timing group that will split off from RED by a coupling reaction and then release FA, n is 0 or 1, FA is a group that can split off from RED by a coupling reaction when n is 0, or a group that can be released from TIME when n is 1, and FA is a development accelerator or a so-called fogging agent that can act on silver halide grains at the time of the developing process to produce fogging nuclei capable of starting the development. As FA can be mentioned groups that act on silver halide grains in a reducing manner at the time of the developing process to produce fogging nuclei, or act on silver halide grains to produce silver sulfide nuclei that are fogging nuclei capable of starting the development.

A preferable group as FA is a group having a group adsorbable onto silver halide grains, and preferably can be represented by $$-AD-(L)_m-X$$

wherein AD represents a group adsorbable onto a silver halide, L represents a divalent group, m is 0 or 1, and X represents a reducing group or a group that can act on a silver halide to produce silver sulfide, provided that when X represents the latter, since in some cases it also can have the function of AD, $AD-(L)_m-$ is not necessarily required.

In formula (I) the group represented by RED has a skeleton of hydroquinone, catechol, o-aminophenol, or p-aminophenol, and it denotes a group that undergoes a redox reaction with the oxidation product of a developing agent and then undergoes an alkaline hydrolysis to release a group $-(TIME)_n-FA$, which is abbreviated "FR" in formulae (IIa) to (VIIa).

Specific examples of such a group are represented by formulae (IIa) to (VIIa):

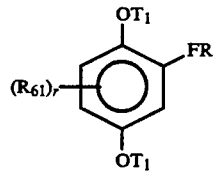

(IIa)

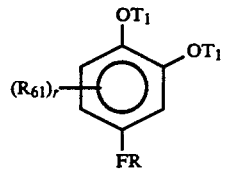

(IIIa)

-continued (IVa)

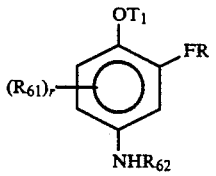

(Va)

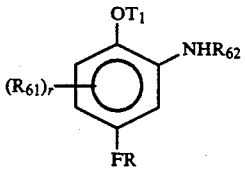

(VIa)

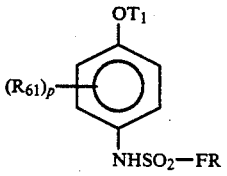

(VIIa)

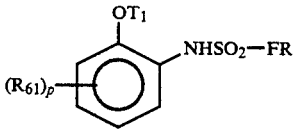

wherein $R_{61}$ represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxy group, a sulfo group, a sulfonyl group, an acyl group, a carbonamide group, a sulfonamide group, a hydroxy group, an acyloxy group, or a heterocyclic group; r is an integer of 1 to 3 ; p is an integer of 1 to 4, when p or r is 2 or over; $R_{61}$'s may be the same or different, or they may form a benzene ring or a 5- to 7-membered heterocyclic ring by linking the two of them located in the vic-positions; $R_{62}$ represents an alkyl group, an aryl group, an acyl group, a carbamoyl group, a sulfonyl group, or a sulfamoyl group; $T_1$ represents a hydrogen atom or a group that can split when hydrolyzed under alkaline conditions, and when there are two $T_1$'s in the molecule they may be different from each other. Typical examples of $T_1$ include a hydrogen atom, an acyl group, a sulfonyl group, an alkoxycarbonyl group, a carbamoyl group, and an oxalyl group.

Preferable specific examples of the compounds represented by formulae (IIa) to (VIIa) are given below, (*) in each structural formula indicating the position where FR is linked.

(1)

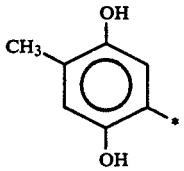

-continued (2)

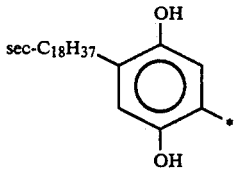

(3)

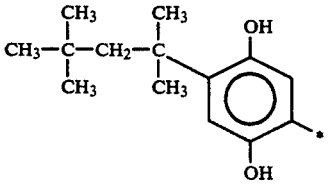

(4)

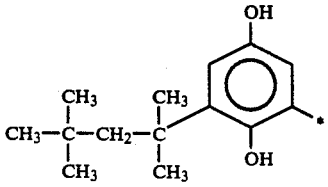

(5)

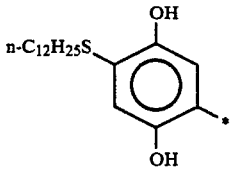

(6)

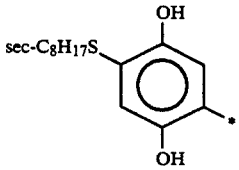

(7)

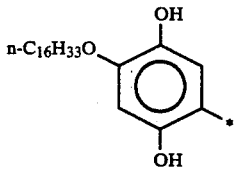

(8)

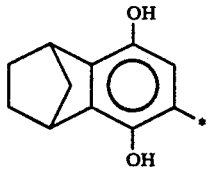

(9)

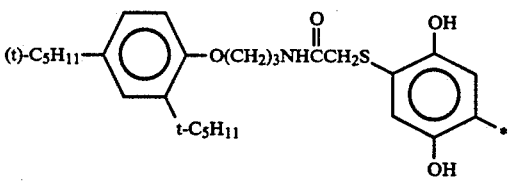

(10)

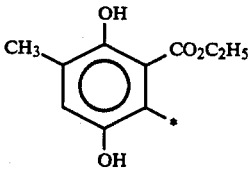

-continued
(11)
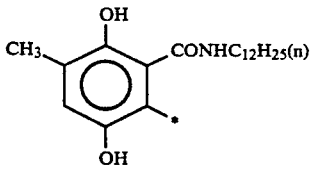
(12)
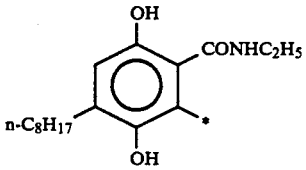
(13)
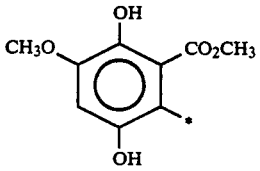
(14)
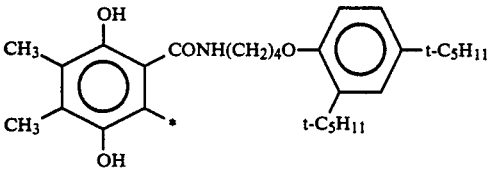
(15)
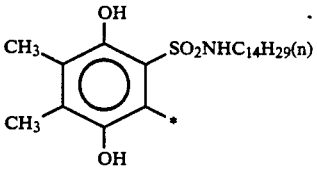
(16)
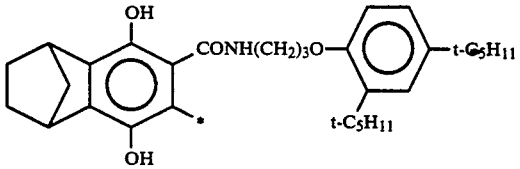
(17)
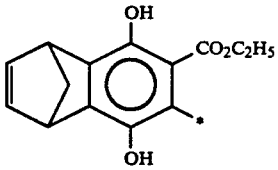
(18)
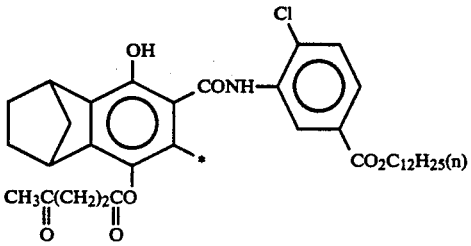
-continued
(19)
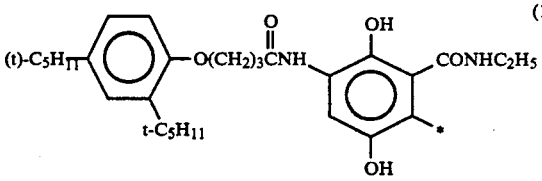
(20)
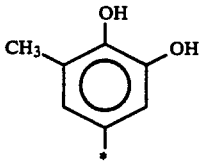
(21)
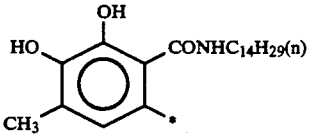
(22)
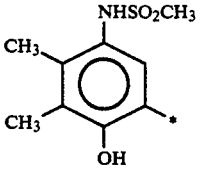
(23)
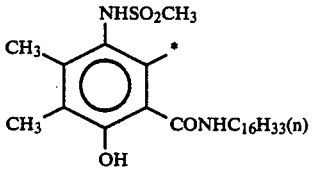
(24)
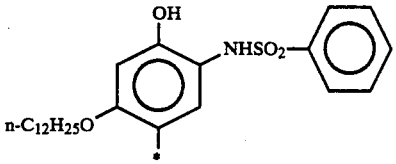
(25)
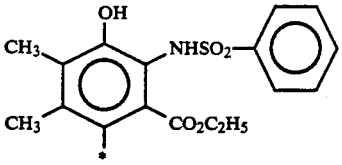
(26)
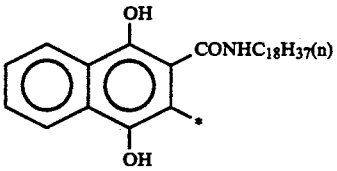
(27)
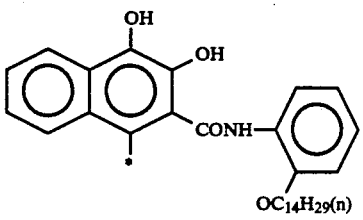

-continued (28)

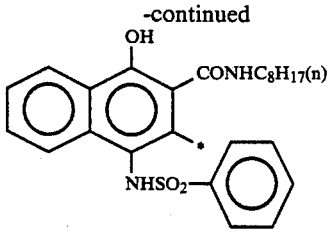

(29)

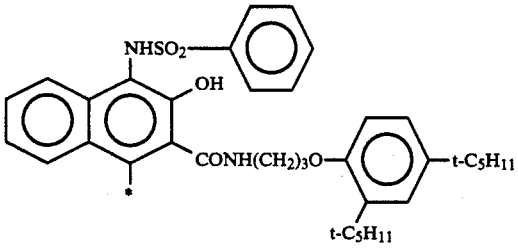

(30)

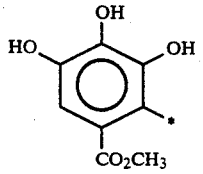

(31)

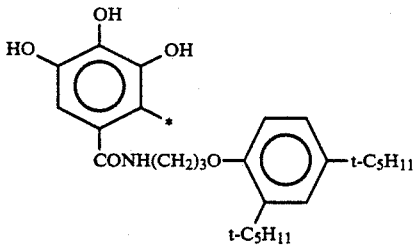

As the timing group represented by TIME can be mentioned ones that can, as described, for example, in U.S. Pat. No. 4,248,962 and JP-A No. 56837/1982, split off from RED by a coupling reaction or a redox reaction and then release FA by intramolecular substitution; ones that can, as described, for example, in British Patent No. 2,072,363 A, JP-A Nos. 154234/1982, 188035/1982, 114946/1981, 56837/1982, 209736/1983, 209737/1983, 209738/1983, 209740/1983, and 98728/1983, release FA by electron transfer via the conjugated system; and coupling components that can, as described, for example, in JP-A No. 111536/1982, release FA by a coupling reaction with the oxidation product of an aromatic primary amine developing agent. These reactions may take place in one step or more than one step.

When FA is a group having AD—$(L)_m$—X, AD may bond directly to the carbon atom of RED, and if L and X can split off by substitution following the redox reaction, they may bond to the carbon atom of RED. One known as a so-called two-equivalent coupling split-off group of a coupler may be present between the carbon of RED and AD. The two-equivalent coupling split-off groups include an alkoxy group (e.g., methoxy), an aryloxy group (e.g., phenoxy), an alkylthio group (e.g., ethylthio), an arylthio group (e.g., phenylthio), a heterocyclic oxy group (e.g., tetrazolyloxy), a heterocyclic thio group (e.g., pyridylthio), and a heterocyclic group (e.g., hydantoinyl, pyrazolyl, trizaolyl, and benzotriazolyl). Further, those described in British Patent Publication No. 2,011,391 can be used as FA.

The group that is represented by AD and can be adsorbed onto a silver halide includes those comprising a nitrogen-containing heterocyclic ring having a dissociable hydrogen atom (e.g., pyrrole, imidazole, pyrazole, triazole, tetrazole, benzimidazole, benzopyrazole, benzotriazole, uracil, tetraazaindene, imidazotetrazole, pyrazolotriazole, and pentaazaindene); a heterocyclic ring having at least one nitrogen atom and another hetero atom, such as an oxygen atom, a sulfur atom, and a selenium atom (e.g., oxazole, thiazole, thiazoline, thiazolidine, thiadiazole, benzothiazole, benzoxazole, and benzoselenazole); a heterocyclic ring having a mercapto group (e.g., 2-mercaptobenzothiazole, 2-mercaptopyrimidine, 2-mercaptobenzoxazole, and 1-phenyl-5-mercaptotetrazole); a quaternary salt (e.g., quaternary salts of a tertiary amine, and pyridine, quinoline, benzthiazole, benzimidazole, and benzoxazole); a thiophenol., an alkylthiol (e.g., cystine); or a compound having a structure of

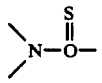

(e.g., thioureas, dithiocarbamates, thioamides, rhodanines, thiazolidinethiones, thiohydantoin, and thiobarbituric acid).

The divalent linking group represented by L in FA is alkylene, alkenylene, phenylene, naphthylene, —O—, —S—, —SO—, —$SO_2$—, —N=N—, carbonyl, amino, imino, amido, thioamido, sulfonamido, ureido, thioureido, or a heterocyclic ring, or one composed of these.

If a group that can be split by the action of a component in the developing solution, such as a hydroxide ion, hydroxylamine, or a sulfite ion, is suitably selected as one of divalent linking groups constituting L, the fogging action can be controlled or inactivated.

The group represented by X includes a reducing compound (e.g., hydrazine, hydrazide, hydrazone, hydroquinone, catechol, p-aminophenol, p-phenylenediamine, 1-phenyl-3-pyrazolidinone, enamines, aldehydes, polyamines, acetylene, aminoboranes, and quaternary salt carbazinic acids such as tetrazolium salts, and ethylenebispyridinium salts), and a compound that can form silver sulfide during development (e.g., a compound having a partial structure of

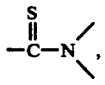

such as thioureas, thioamides, thiocarbamates, rhodanines, thiohydantoin, and thiazolidinethion). Of the groups represented by X, some groups that can form silver sulfide during development can be adsorbed themselves onto silver halide grains and can also act as the group AD capable of being adsorbed.

Particularly preferable compounds of FA are represented by the following formulae (VIIIa) and (IXa):

Formula (VIIIa)

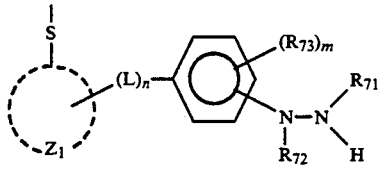

Formula (IXa)

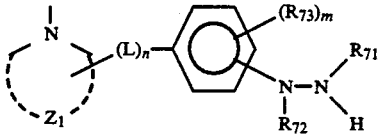

wherein $R_{71}$ represents an acyl group, a carbamoyl group, an alkylsulfonyl group, an arylsulfonyl group, an alkoxycarbonyl group, an aryloxycarbonyl group, or a sulfamoyl group; $R_{72}$ represents a hydrogen atom, an acyl group, an alkoxycarbonyl group, an alkylsulfonyl group, an arylsulfonyl group, or an aryloxycarbonyl group; $R_{73}$ represents a halogen atom, an alkoxy group, an alkyl group, an alkenyl group, an aryl group, an aryloxy group, an alkylthio group, an arylthio group, a carbonamido group, or a sulfonamido group; m is an integer of 0 to 4; when m is 2 or over, $R_{73}$'s may be the same or different, and two or more $R_{73}$'s may be bonded to form a condensed ring; L has the same meaning as defined above, that is, it represents a divalent linking group; n is 0 or 1; $Z_1$ represents a group of nonmetallic atoms required for forming a monocyclic or condensed heterocyclic ring., and $Z_2$ represents a group of nonmetallic atoms required for forming together with N a monocyclic or condensed heterocyclic ring.

Examples of the substituents are further described below. As $R_{71}$ can be mentioned an acyl group (e.g., formyl, acetyl, propionyl, trifluoroacetyl, and pyruvoyl), a carbamoyl group (e.g., dimethylcarbamoyl), an alkylsulfonyl group (e.g., methanesulfonyl), an arylsulfonyl group (e.g., benzenesulfonyl), an alkoxycarbonyl group (e.g., methoxycarbonyl), an aryloxycarbonyl group (e.g., phenoxycarbonyl), or a sulfamoyl group (e.g., methylsulfamoyl), as $R_{72}$ can be mentioned a hydrogen atom, an acyl group (e.g., trifluoroacetyl), an alkoxycarbonyl group (e.g., methoxycarbonyl), an aryloxycarbonyl group (e.g., phenoxycarbonyl), an alkylsulfonyl group (e.g., methanesulfonyl), or an arylsulfonyl group (e.g., benzenesulfonyl); and as $R_{73}$ can be mentioned a halogen atom (e.g., fluorine and chlorine), an alkoxy group (e.g., methoxy and methoxyethoxy), an alkyl group (e.g., methyl and hydroxymethyl), an alkenyl group (e.g., allyl), an aryl group (e.g., phenyl), an aryloxy group (e.g., phenoxy), an alkylthio group (e.g., methylthio), an arylthio group (e.g., phenylthio), a carbonamido group (e.g., acetamido), or a sulfonamido group (e.g., methanesulfonamidq). Examples of

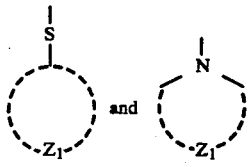

are given in examples of AD mentioned later.

Further, preferable examples of AD have the following formula (Xa):

Formula (Xa)

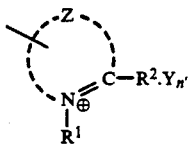

wherein Z represents a group of nonmetallic atoms required to form a 5- to 6-membered heterocyclic ring, and may be substituted by a substituent; $R^1$ represents an aliphatic group; $R^2$ represents a hydrogen atom, an aliphatic group, or an aromatic group, and may be joined to Z to form a ring; $R^1$ and $R^2$ each may be substituted by a substituent; the aliphatic group represented by $R^1$ and $R^2$ is an unsubstituted alkyl group having 1 to 18 carbon atoms, or an alkyl group whose alkyl moiety has 1 to 18 carbon atoms; as the substituent on the alkyl group represented by $R^1$ and $R^2$ can be mentioned those on Z given later; the aromatic group represented by $R^2$ is one having 6 to 20 carbon atoms, such as a phenyl group and a naphthyl group; as the substituent on the aromatic group represented by $R^2$ can be mentioned those on Z given later, provided that at least one of the groups represented by $R^1$, $R^2$, and Z contains an alkynyl group, an acyl group, a hydrazine group, or a hydrazone group, or that $R^1$ and $R^2$ together form a 6-membered ring to form a dihydropyridinium skeleton; Y represents a counter ion for balancing the charge; and n' is 0 or 1.

In formula (Xa) an arbitrary position may have a bond line.

Formula (Xa) is further described in detail. The heterocyclic ring completed by Z include quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthooxazolium, and benzoxazolium nuclei. Substituents on Z include, for example, an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonate group, a hydrazine group, a hydrazone group, and an imino group. As a substituent on Z, for example, at least one of the above substituents is selected, but if two or more substituents are present on Z, they may be the same or different. The substituent may be further substituted by the substituents mentioned above.

Further, the substituent on Z may have a heterocyclic quaternary ammonium group that is completed by Z through the linking group L. In this case a so-called dimer structure is formed.

The heterocyclic ring completed by Z includes quinolinium, benzothiazolium, benzimidazolium, pyridinium, acridinium, phenanthridinium, and isoquinolinium nuclei, with quinolinium, benzothiazolium, and benzimidazolium nuclei preferable, quinolinium and benzothiazolium nuclei more preferable, and a quinolinium nucleus the most preferable.

Of the groups represented by $R^1$, $R^2$, and Z, at least one group has an alkynyl group, an acyl group, a hydrazine group, or a hydrazone group, or $R^1$ and $R^2$ together form a 6-membered ring to form a dihydropyridinium skeleton, which may be substituted by a substituent of the substituents on the group represented by Z mentioned above.

As the hydrazine group, one having an acyl group or a sulfonyl group among others as a substituent is preferable.

As the hydrazone group, one having an aliphatic group or an aromatic group is preferable.

As the acyl group, for example, a formyl group and an aliphatic or aromatic ketones are preferable.

As the alkynyl possessed by any one of $R^1$, $R^2$, or Z, although stated partly before, if further described in detail, is preferably one having 2 to 18 carbon atoms, such as an ethynyl group, a propargyl group, a 2-butynyl group, a 1-methylpropargyl group, a 1,1-dimethylpropargyl group, a 3-butynyl group, and a 4-pentynyl group.

Further, these may be substituted by a group stated as substituent on Z. Examples thereof include a 3-phenylpropargyl group, a 3-methoxycarbonylpropargyl group, and a 4-methoxy-2-butynyl group.

It is preferable that at least one of substituents on the groups or rings represented by $R^1$, $R^2$, and Z is an alkynyl group or an acyl group, or $R^1$ and $R^2$ join together to form a dihydropyridinium skeleton, and it is the most preferable that substituents on the groups or rings represented by $R^1$, $R^2$, and Z include at least one alkynyl group.

In particular, it is the most preferable that $R^1$ is a propargyl group.

The counter ion Y for balancing the charge is any anion capable of cancelling the positive charge produced by the quaternary ammonium salt in the heterocyclic ring, for example a bromide ion, a chloride ion, an iodide ion, a p-toluenesulfonate ion, an ethylsulfonate ion, a perchlorate ion, a trifluoromethanesulfonate ion, and a thiocyanate ion. In this case n' is 1. When the heterocyclic quaternary ammonium salt includes an anion substituent such as a sulfoalkyl substituent, the salt may be in the form of a betaine, and in this case the counter ion is not needed, and n' is 0. When the heterocyclic quaternary ammonium salt has two anion substituents, for example two sulfoalkyl groups, Y is a cationic counter ion, such as an alkali metal ion (e.g., a sodium ion and a potassium ion) and an ammonium salt (e.g., triethyl ammonium).

Examples of the FR compounds used in the present invention are described, for example, in JP-A Nos. 150845/1982, 50439/1984, 157638/1984, 170840/1984, 37556/1985, 147029/1985, and 128446/1985.

Examples of AD are given below. The free bond lines are linked to $-(L)_m-X$ and $-(TIME)_n-$.

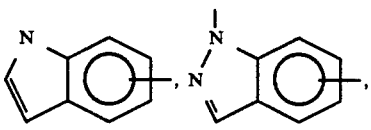

-continued

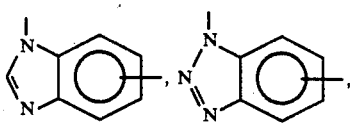

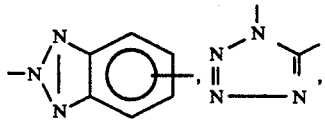

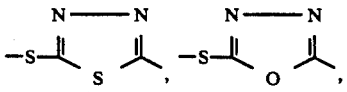

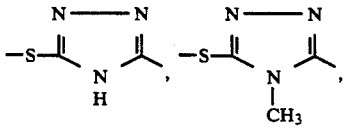

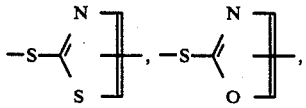

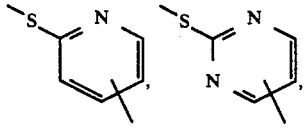

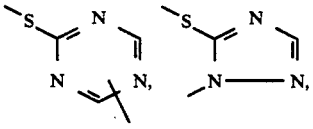

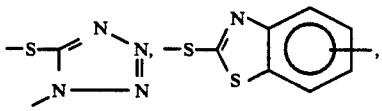

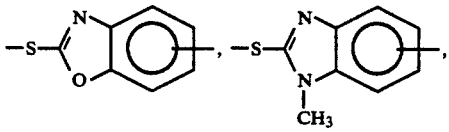

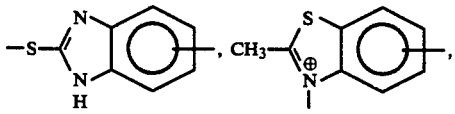

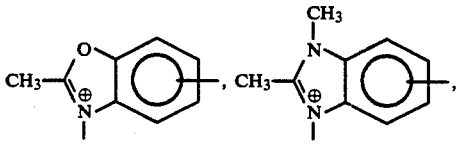

-continued
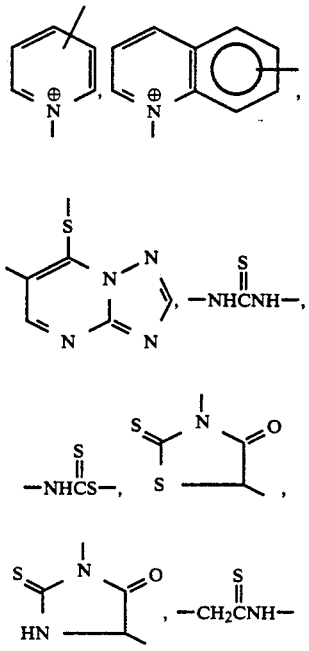
Examples of L are shown below.
$-CH_2-$, $-CH_2CH_2-$,
$-OCH_2-$, $-OCH_2CH_2-$,
$-SCH_2-$, $-COO-$,
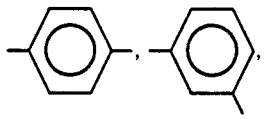
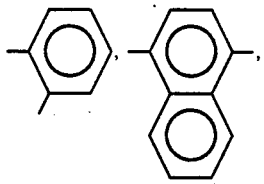
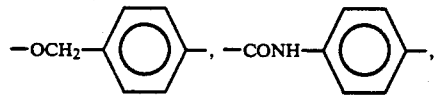
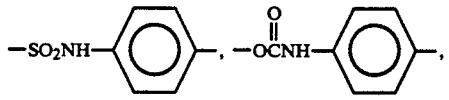
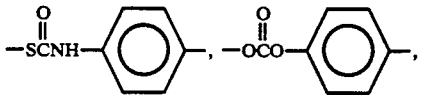
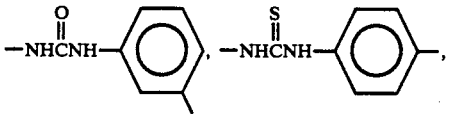
-continued
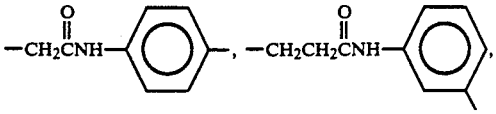
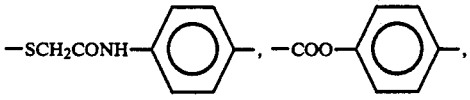
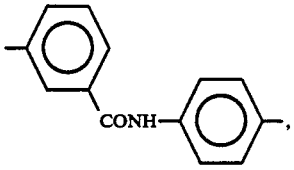
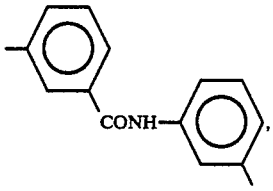
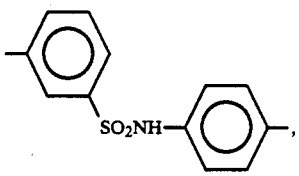
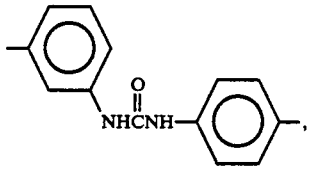
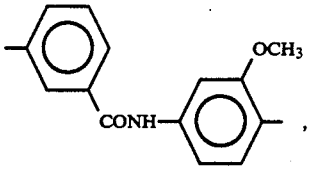
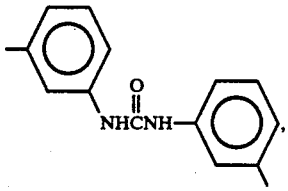
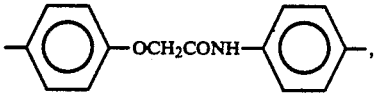

-continued
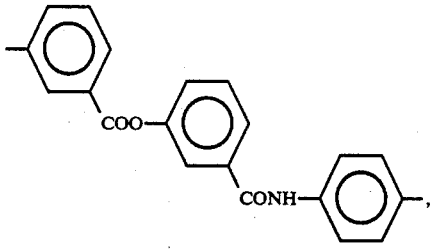
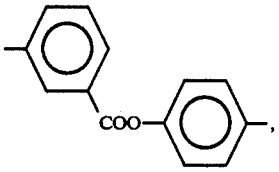
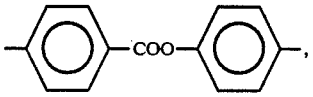
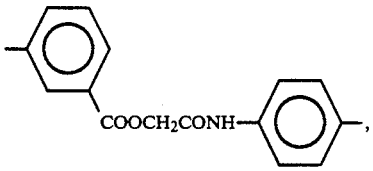
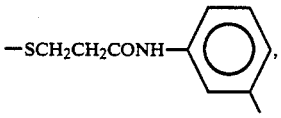
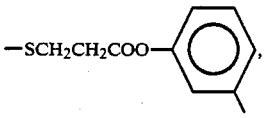
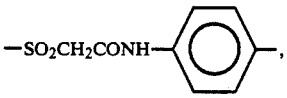
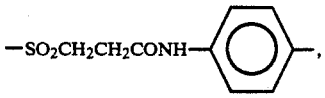
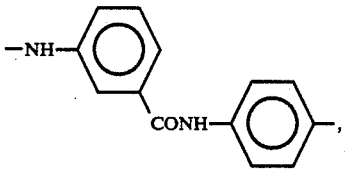
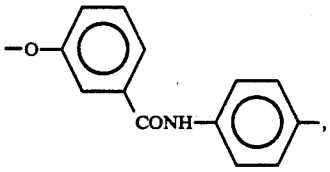
-continued
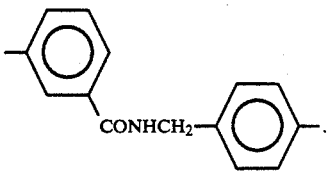
Examples of X are shown below.
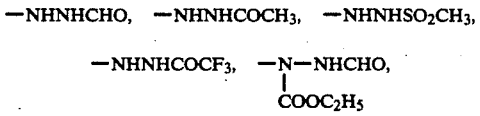
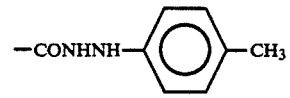
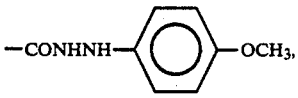
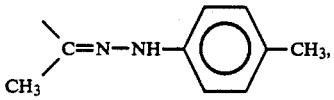
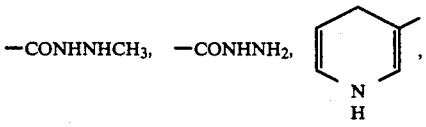
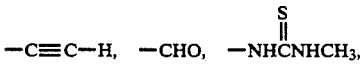
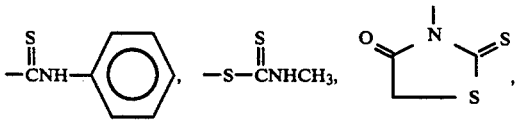
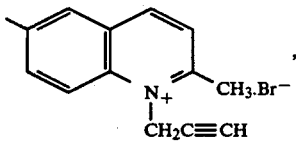
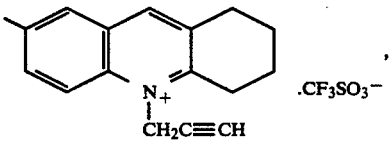
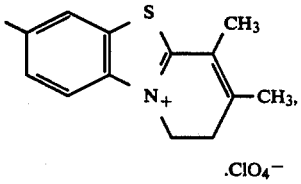

-continued
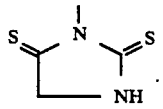
Preferred examples of FA in formula (I) are given below.
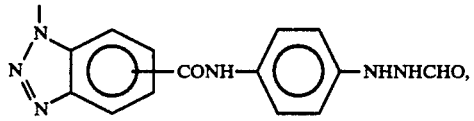
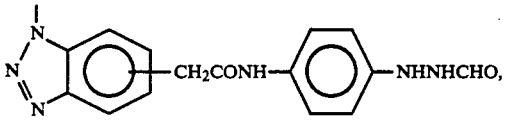
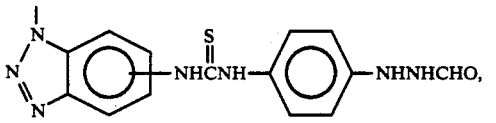
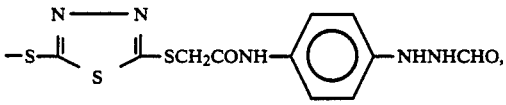
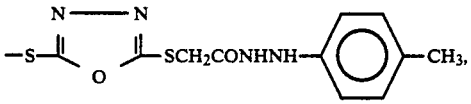
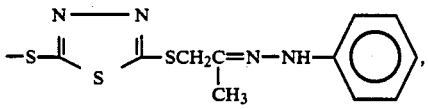
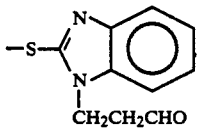
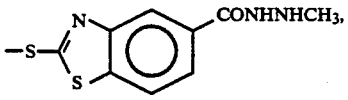
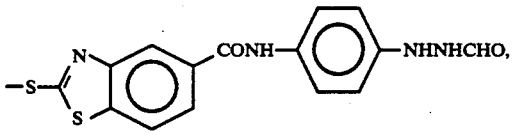
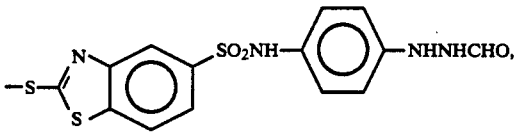
-continued
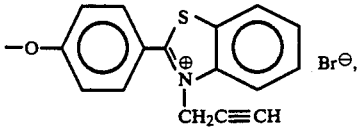
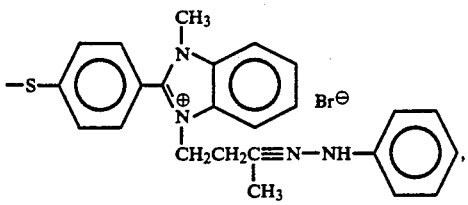
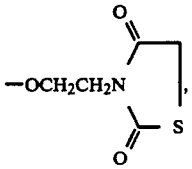
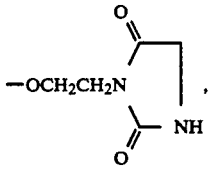
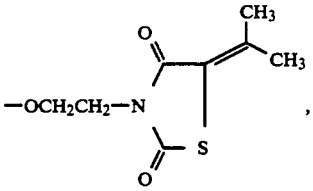
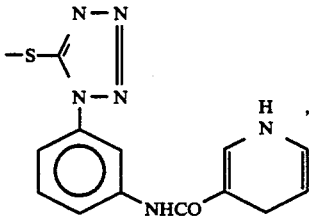
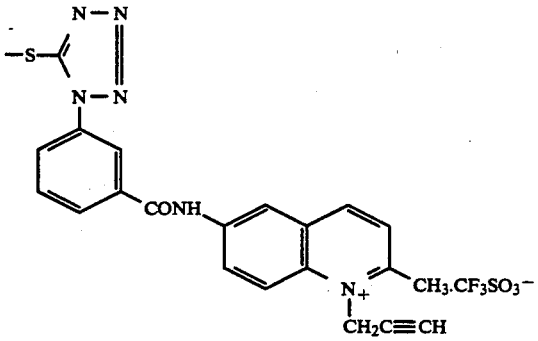
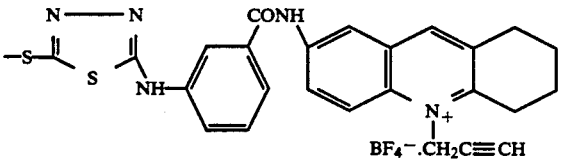

-continued
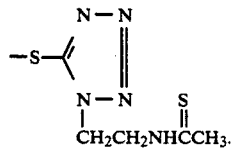
Examples of FR compound for use in the present invention are as follows:
(1-1)
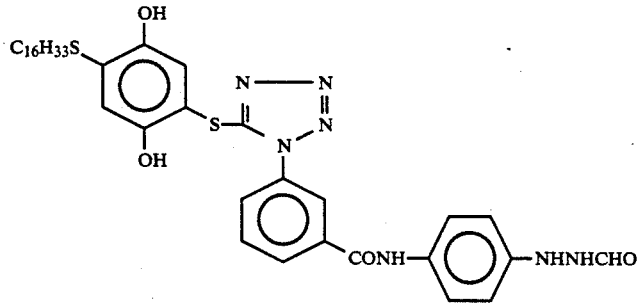
(1-2)
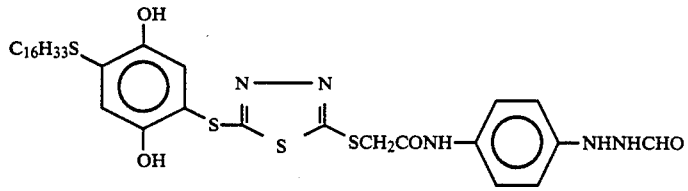
(1-3)
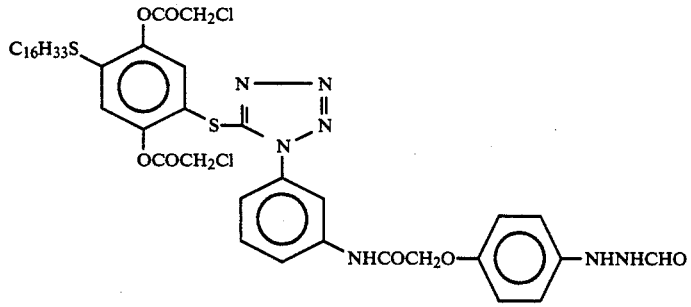
(1-4)
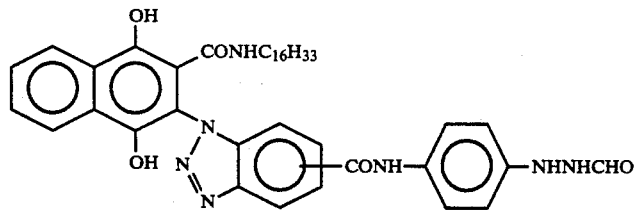
(1-5)
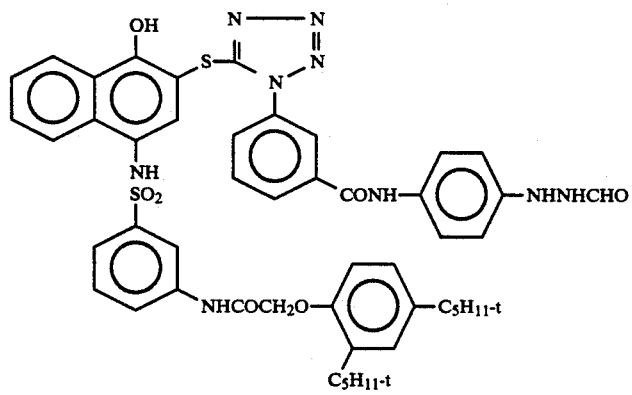

-continued
(1-6)
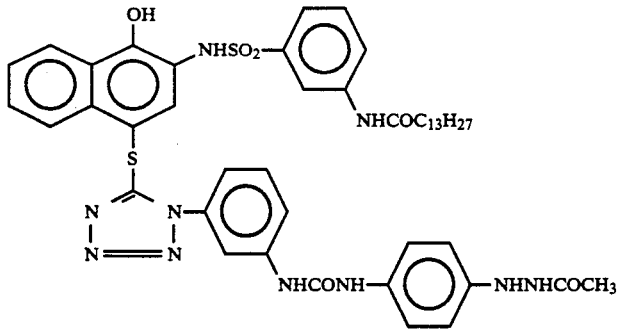
(1-7)
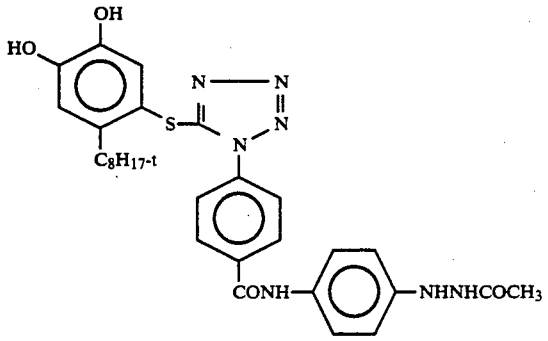
(1-8)
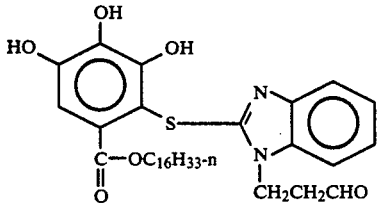
(1-9)
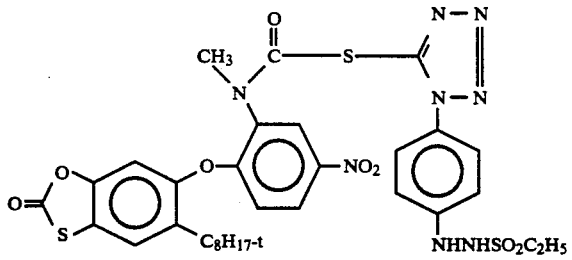
(1-10)
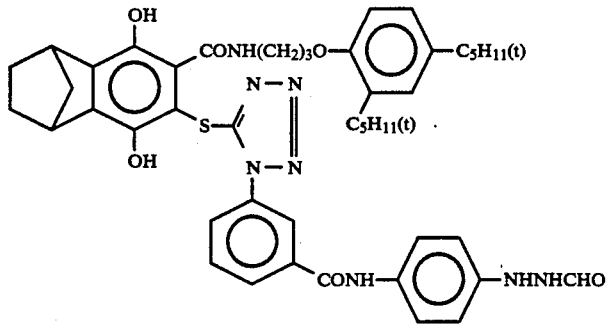

-continued
(1-11)
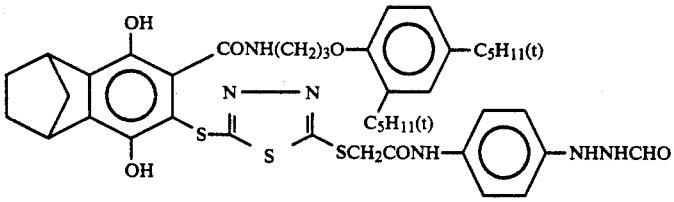
(1-12)
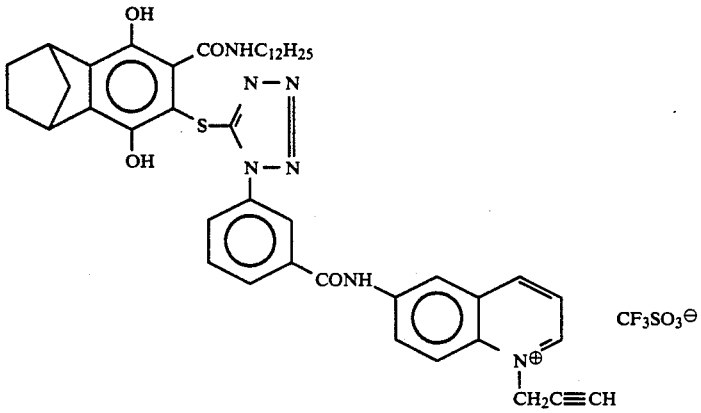
(1-13)
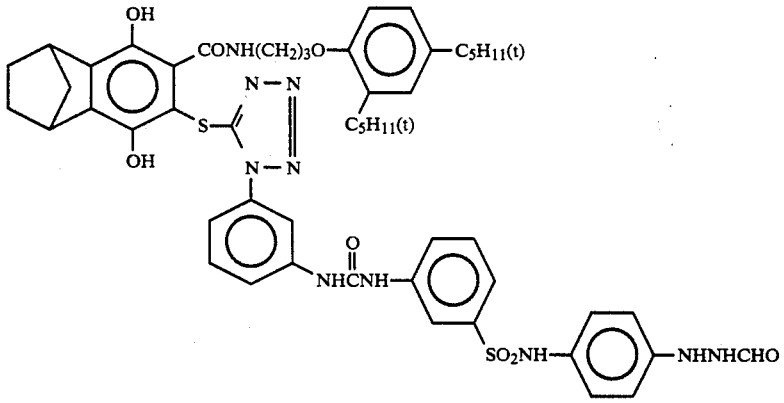
(1-14)
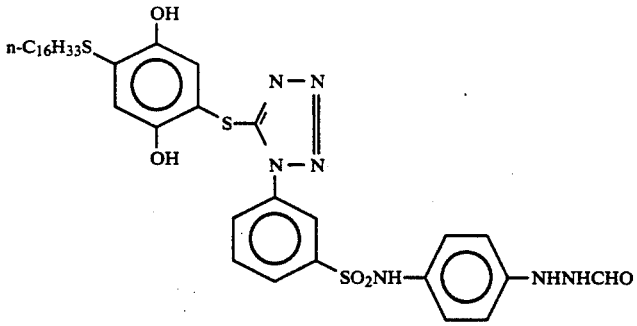
(1-15)
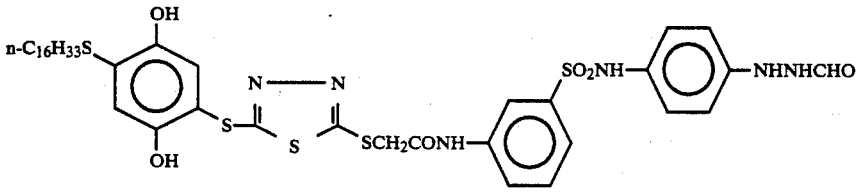

-continued
(1-16)
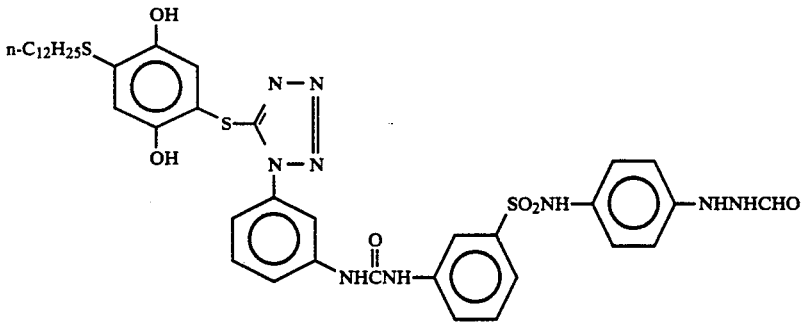
(1-17)
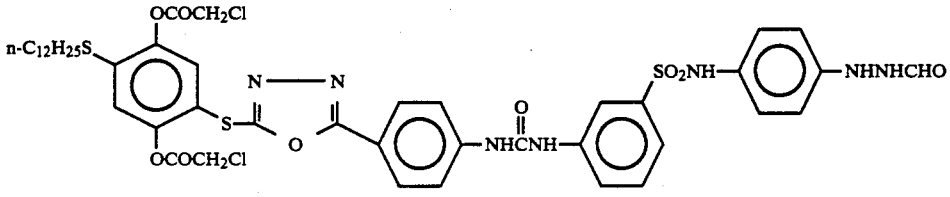
(1-18)
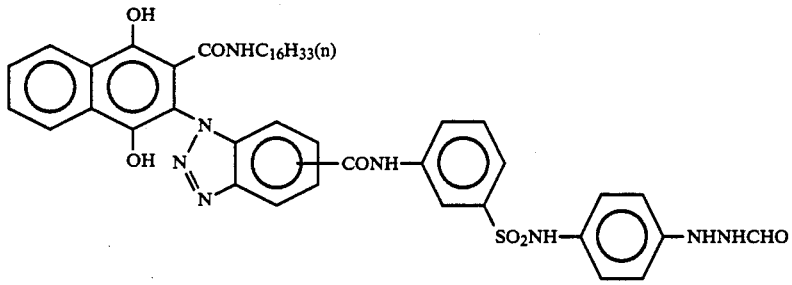
(1-19)
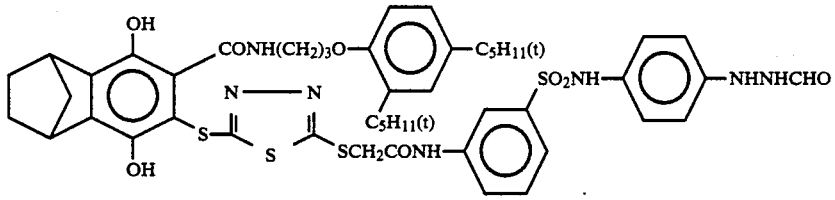
(1-20)
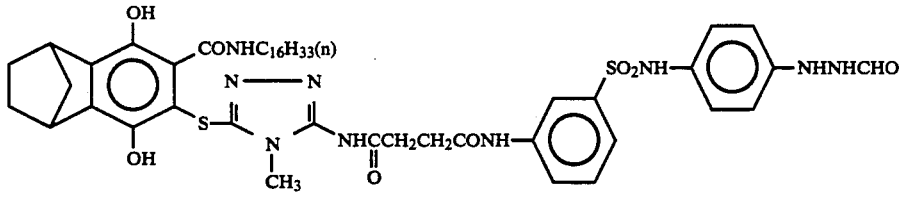
(1-21)
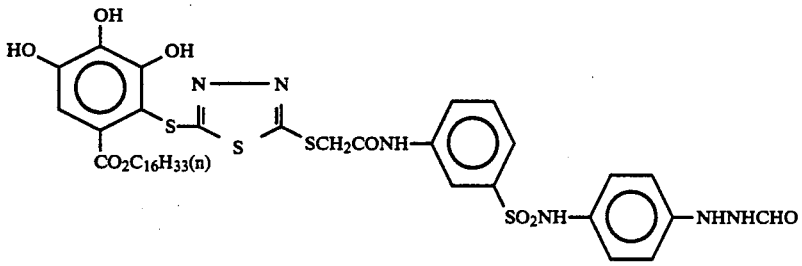

-continued
(1-22)
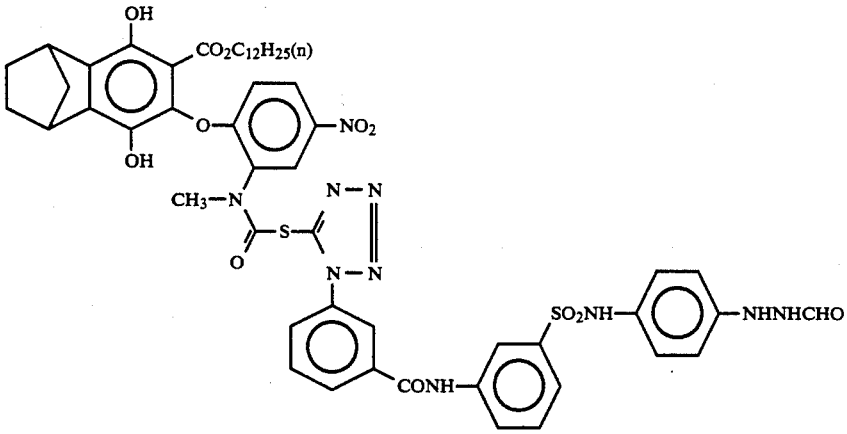
(1-23)
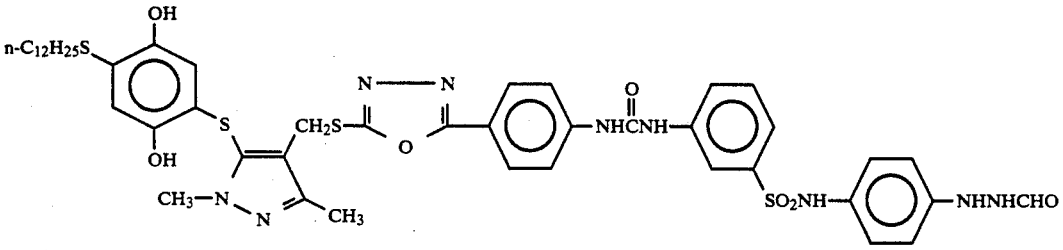
(1-24)
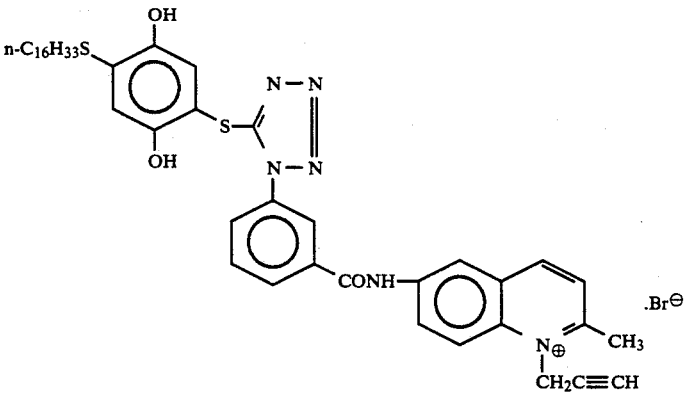
(1-25)
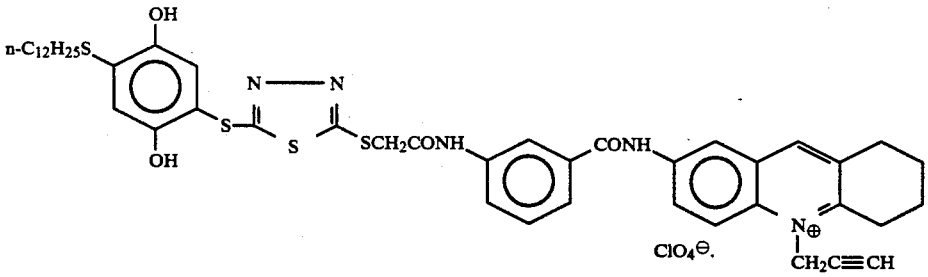
(1-26)
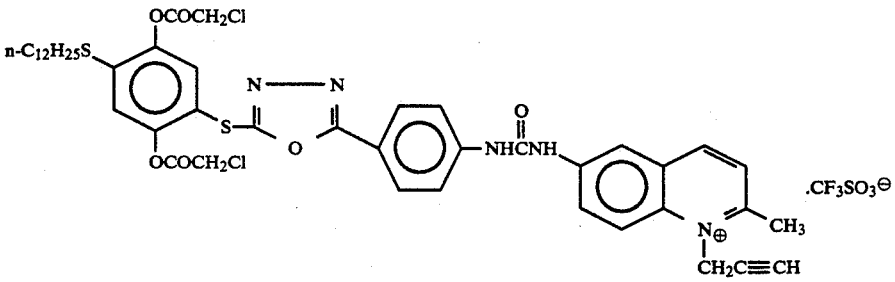

-continued
(1-27)
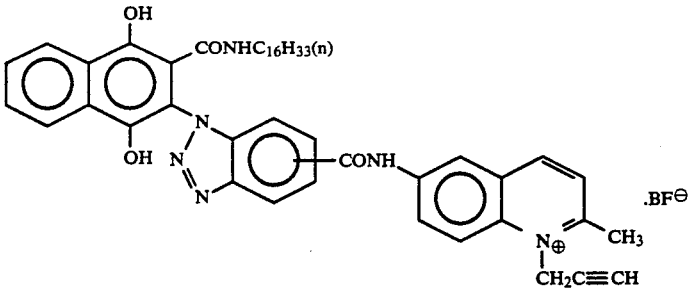
(1-28)
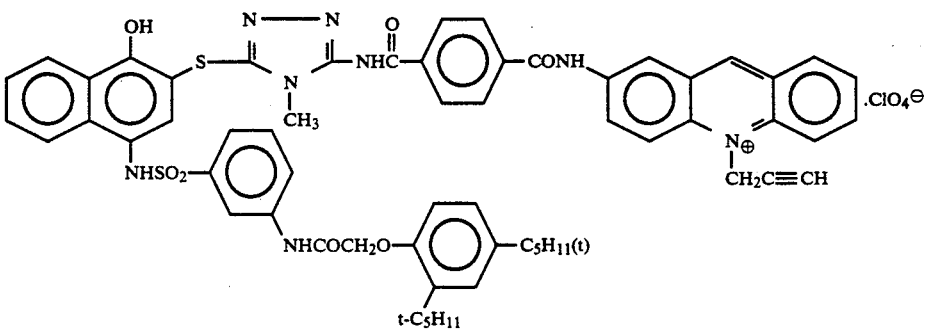
(1-29)
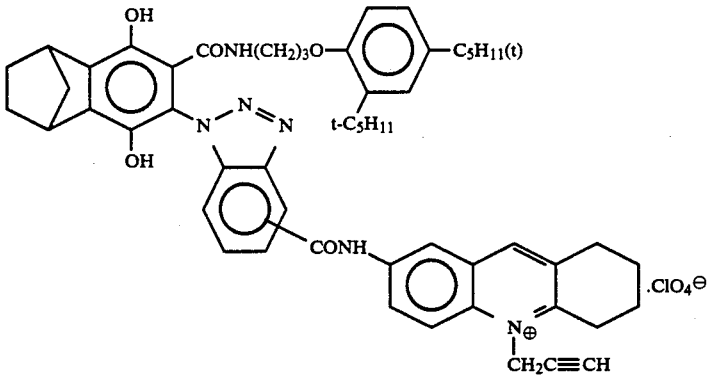
(1-30)
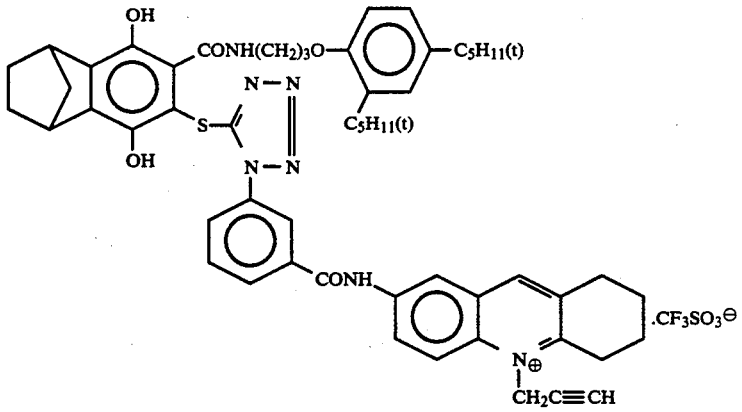

-continued
(1-31)
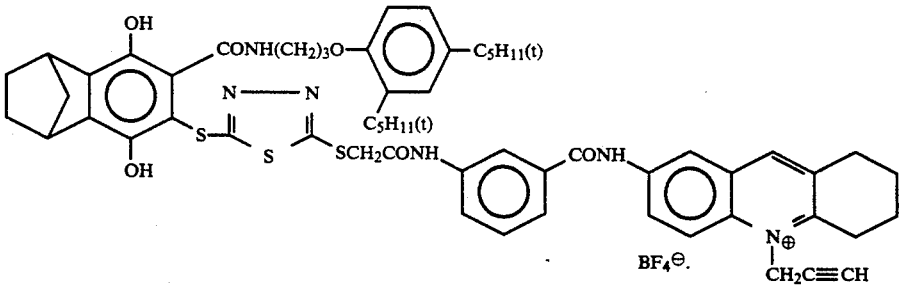
(1-32)
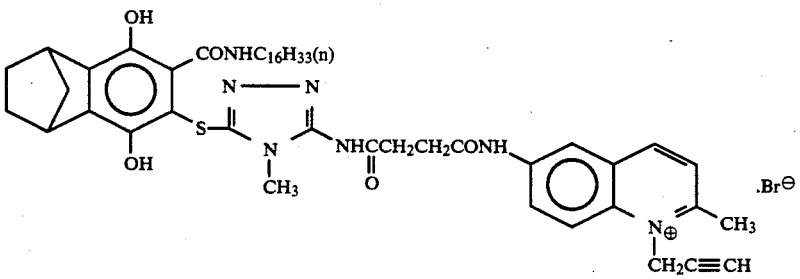
(1-33)
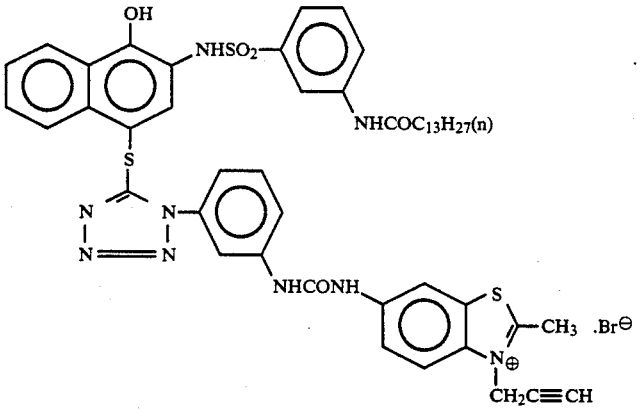
(1-34)
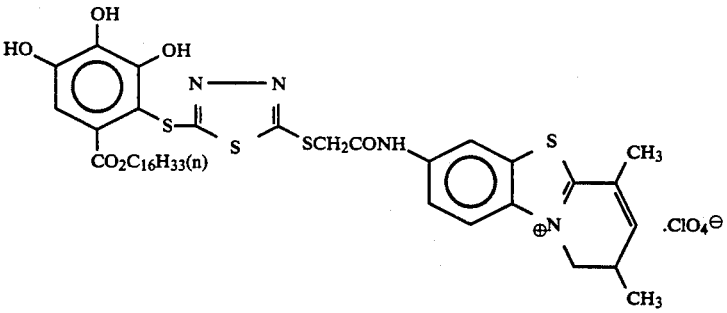
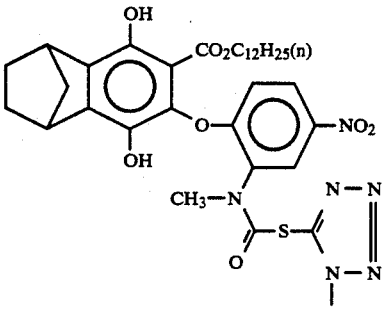

-continued (1-35)

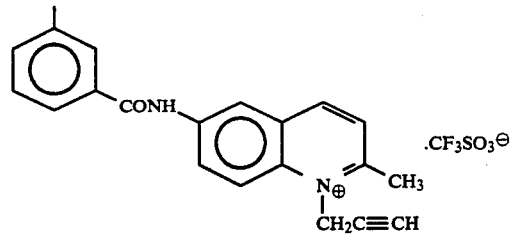

(1-36)

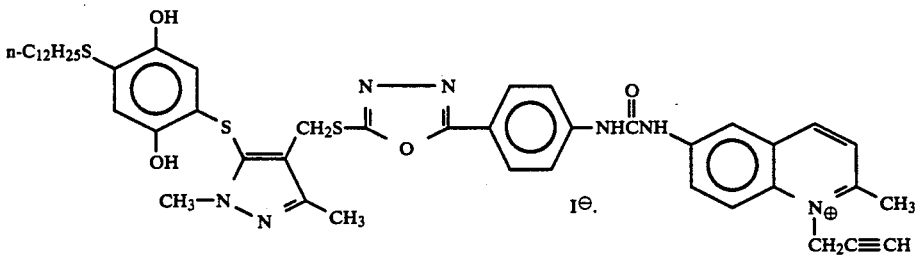

Compounds used in the present invention can be synthesized, for example, in similar manner to methods described in JP-A Nos. 150845/1982, 157638/1984, and 107029/1985.

The FR compounds can be synthesized according to methods described, for example, in patents cited in *Research Disclosure* No. 22534 (issued January 1983), pages 50 to 54, and U.S. Pat. No. 4,471,044 or methods similar thereto.

The amount of the FR compound to be added that is used in the present invention is $10^{-9}$ to $10^{-1}$ preferably $10^{-6}$ to $10^{-1}$ mol, and more preferably $10^{-5}$ to $10^{-2}$ mol, per mol of silver of the silver halide contained in the layer in which the FR compound is added, or in the layer adjacent to the former layer.

In the present invention, to introduce the FR compound into a silver halide emulsion layer, a known method, for example, as described in U.S. Pat. No. 2,322,027 can be used. For example, after the FR compound is dissolved, for example, in an alkyl phthalate (e.g., dibutyl phthalate, and dioctyl phthalate), a phosphate (e.g., diphenyl phosphate, triphenyl phosphate, tricresyl phosphate, and dioctylbutyl phosphate), a citrate (e.g., tributyl acetylcitrate), a benzoate (e.g., octyl benzoate), an alkylamide (e.g.. diethyllaurylamide), an aliphatic acid ester (e.g., dibutoxyethyl succinate and diethyl azelate), or a trimesate (e.g., tributyl trimesate), or in an organic solvent having a boiling point of about 30° to 150° C., for example a lower alkyl acetate such as ethyl acetate and butyl acetate, ethyl propionate, secondary butyl alcohol, methyl isobutyl ketone, β-ethoxyethyl acetate, methyl "Cellosolve" acetate, methanol, ethanol, propanol, and fluorinated alcohols, it is dispersed in a hydrophilic colloid. The above mentioned high-boiling point organic solvent and the above-mentioned high-boiling low-boiling point organic solvent may be used as a mixture thereof.

Methods of dispersing by using a polymer described in JP-B ("JP-B" means examined Japanese patent publication) No. 39853/1986, and JP-A No. 59943/1986 can also be used.

If the FR compound has an acid group, such as a carboxylic group or a sulfonic group, the FR compound can be introduced as an alkaline solution into a hydrophilic colloid.

In the present invention, compounds represented by below-mentioned formulae (II), (III), (IV), (V), and (VI) can be used preferably. These compounds have an effect of controlling undesired photographic performances, such as an increase in fogging of the film and a rise in sensitivity of the film with time.

Formula (II)

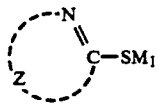

wherein $M_1$ represents a hydrogen atom, a cation, or a protective group for the mercapto group that can be split off with an alkali, and Z represents a group of atoms required to form a 5- to 6-membered heterocyclic ring.

More particularly, $M_1$ represents a hydrogen atom, a cation (e.g., a sodium ion, a potassium ion, and an ammonium ion), or a protective group (e.g., —COR', —COOR', and —$CH_2CH_2$COR', wherein R' represents a hydrogen atom, an alkyl group, an aralkyl group, an aryl group, or the like) for the mercapto group that can be split off with an alkali.

Z represents a group of atoms required to form a 5- to 6-membered heterocyclic ring. The heterocyclic ring includes, as the hetero atom, a sulfur atom, a selenium atom, a nitrogen atom, an oxygen atom, etc., and it may be condensed and may have a substituent on the heterocyclic ring or on the condensed ring.

Examples of Z are tetrazole, triazole, imidazole, oxazole, thiadiazole, pyridine, pyrimidine, triazine, azabenzimidazole, purine, tetraazaindene, triazaindene, pentaazaindene, benztriazole, benzimidazole, benzoxazole, benzthiazole, benzselenazole, and naphthoimidazole. Examples of the substituent on these rings are an alkyl group (e.g., methyl, ethyl, n-hexyl, hydroxyethyl, and carboxyethyl), an alkenyl group (e.g., allyl), an aralkyl group (e.g., benzyl and phenethyl), an aryl group (e.g., phenyl, naphthyl, p-acetamidophenyl, p-carboxyphenyl, m-hydroxyphenyl, p-sulfamoylphenyl, p-acetylphenyl, o-methoxyphenyl, 2,4-diethylaminophenyl, and 2,4-dichrolophenyl), an alkylthio group (e.g., methylthio, ethylthio, and n-butylthio), an arylthio group (e.g., phenylthio and naphthylthio), an aralkylthio group (e.g., benzylthio), and a mercapto group. Further, in particular, on the condensed ring may be present, other than the above substituent, for example a nitro group, an amino group, a halogen atom, a carboxyl group, and a sulfo group.

Preferable specific examples of the compound represented by formula (II) are given below, but the present invention is not limited to them.

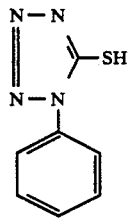
(II-1)

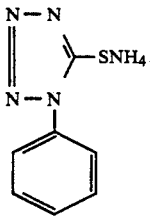
(II-2)

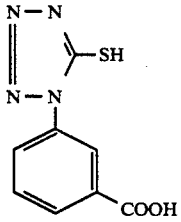
(II-3)

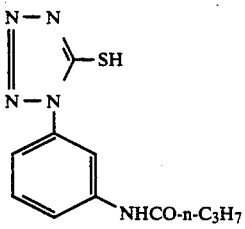
(II-4)

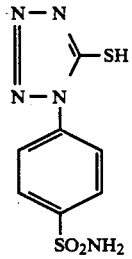
(II-5)

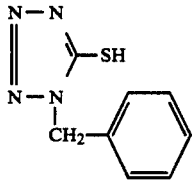
(II-6)

-continued

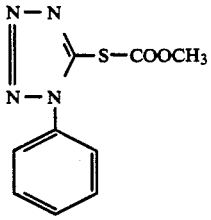
(II-7)

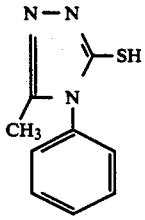
(II-8)

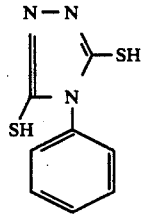
(II-9)

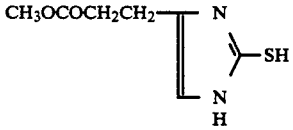
(II-10)

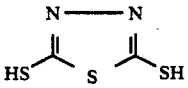
(II-11)

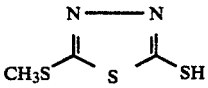
(II-12)

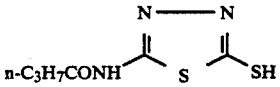
(II-13)

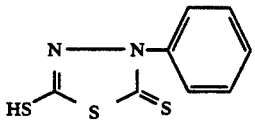
(II-14)

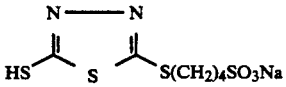
(II-15)

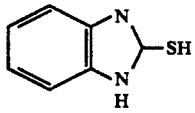
(II-16)

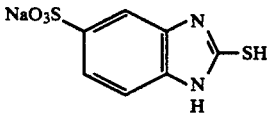
(II-17)

-continued
(II-18)
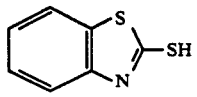
(II-19)
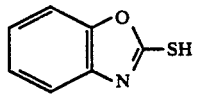
(II-20)
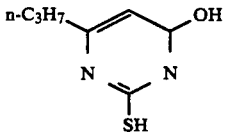
(II-21)
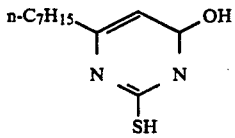
(II-22)
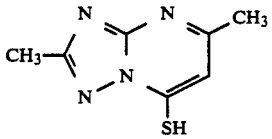
(II-23)
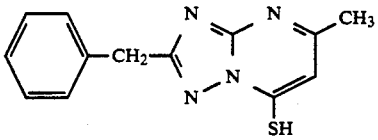
(II-24)
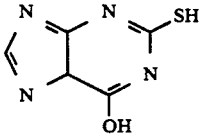
(II-25)
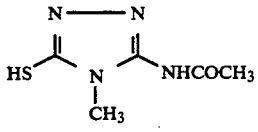
(II-26)
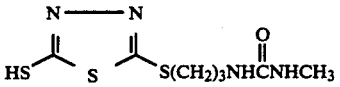
(II-27)
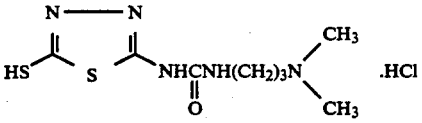
(II-28)
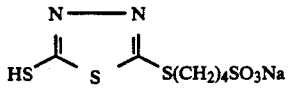
(II-29)
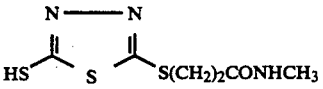
-continued
(II-30)
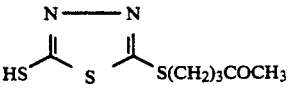
(II-31)
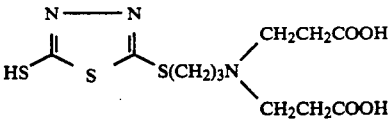
(II-32)
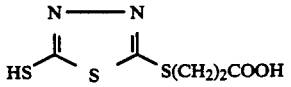
(II-33)
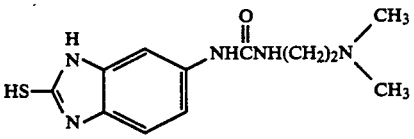
(II-34)
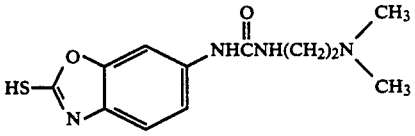
(II-35)
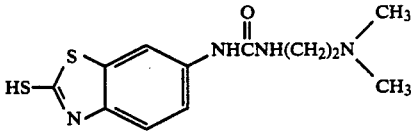
(II-36)
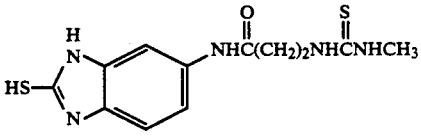
(II-37)
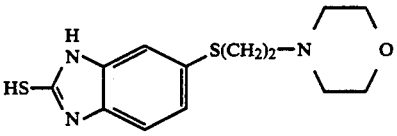
(II-38)
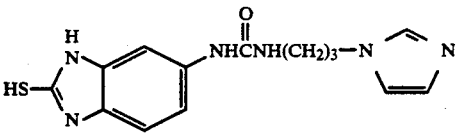
(II-39)
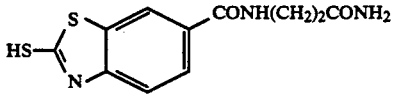
(II-40)
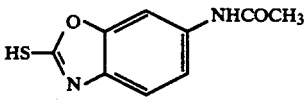
(II-41)
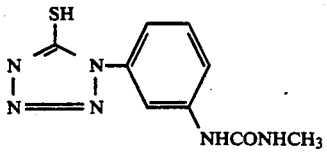

-continued (II-42)

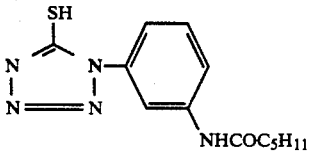

(II-43)

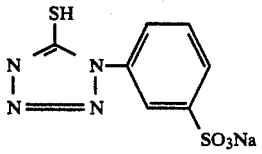

(II-44)

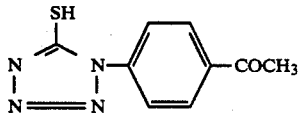

(II-45)

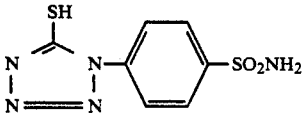

(II-46)

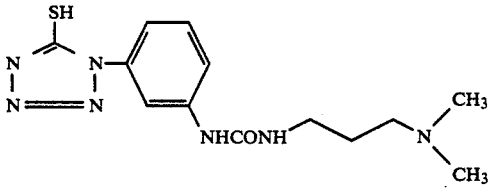

.HCl (II-47)

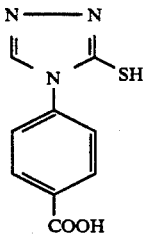

(II-48)

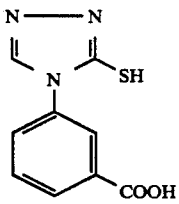

(II-49)

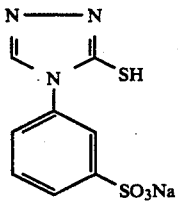

(II-50)

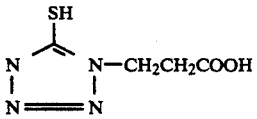

-continued (II-51)

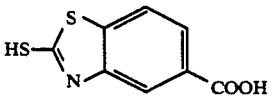

(II-52)

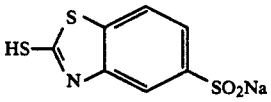

.$3H_2O$ (II-53)

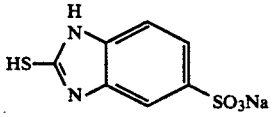

.$2H_2O$ (II-54)

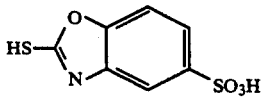

.$H_2O$

Formula (III)

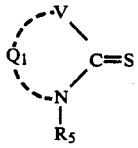

wherein $R_5$ represents a hydrogen atom or a substituted or unsubstituted alkyl, aralkyl, alkenyl, or aryl group, or heterocyclic residue; V represents O, S, Se, or $NR_6$, in which $R_6$ represents an alkyl group, an aralkyl group, an alkenyl group, an aryl group, or a heterocyclic ring residue; $R_6$ and $R_5$ may be the same or different; and $Q_1$ represents a group of atoms required to form a 5- to 6-membered heterocyclic ring, which may be condensed.

The alkyl group represented by $R_5$ and $R_6$ has 1 to 20 carbon atoms, and it may have a substituent. Examples of the substituent are a halogen atom (e.g., a chlorine atom), a cyano group, a carboxy group, a hydroxy group, an acyloxy group having 2 to 6 carbon atoms (e.g., acetoxy), an alkoxycarbonyl group having 2 to 22 carbon atoms (e.g., ethoxycarbonyl and butoxycarbonyl), a carbamoyl group, a sulfamoyl group, a sulfo group, an amino group, and a substituted amino group. Advantageous examples of the alkyl group are methyl, ethyl, n- or iso-propyl, n-, iso-, or t-butyl, and amyl, hexyl, octyl, dodecyl, pentadecyl, heptadecyl, chloromethyl, 2-chloroethyl, 2-cyanoethyl, carboxymethyl, 2-carboxyethyl, 2-hydroxylethyl, 2-acetoxyethyl, acetoxymethyl, ethoxycarbonylmethyl, butoxycarbonylmethyl, 2-methoxycarbonylethyl, benzyl, o-nitrobenzyl, and p-sulfobenzyl, which may be branched.

The aralkyl group represented by $R_5$ and $R_6$ has preferably 7 to 20 carbon atoms, and examples thereof are a benzyl group and a phenethyl group.

The alkenyl group represented by $R_5$ and $R_6$ has preferably 2 to 18 carbon atoms, and an example thereof is an ally group.

The aryl group represented by $R_5$ and $R_6$ preferably is one having 6 to 10 carbon atoms, and a monocyclic or dicyclic one, with a monocyclic aryl group preferred, which may be substituted. Examples of the substituent are an alkyl group having 1 to 20 carbon atoms (e.g., methyl, ethyl, and nonyl), an alkoxy group having 1 to 20 carbon atoms (e.g., methoxy and ethoxy), a hydroxyl group, a halogen atom (e.g., chlorine and bromine), a carboxyl group, and a sulfo group. Examples of the aryl group are a phenyl group, a p-tolyl group. a p-methoxyphenyl group, a p-hydroxyphenyl group, a p-chlorophenyl group, a 2,5-dichlorophenyl group, a p-carboxyphenyl group, an o-carboxyphenyl group, a 4-sulfophenyl group, a 2,4-disulfophenyl group, a 2,5-disulfophenyl group, a 3-sulfophenyl group, and a 3,5-disulfophenyl group.

$Q_1$ represents a group of atoms selected preferably from C, S, N, and O required to form a 5- to -membered heterocyclic ring, such as a thiazoline ring, a thiazolidine ring, a selenazoline ring, an oxazoline ring, an oxazolidine ring, an imidazoline ring, an imidazolidine ring, a 1,3,4-thiadiazoline ring, a 1,3,4-oxadiazoline ring, a 1,3,4-triazoline ring, a tetrazoline ring, and a pyrimidine ring, to which a 5- to 7-membered carbocyclic or heterocyclic ring may be condensed. That is, a benzothiazoline nucleus, a naphthothiazoline nucleus, a dihydronaphthothiazoline nucleus, a tetrahydrobenzothiazoline nucleus, a benzoselenazoline nucleus, a benzoxazoline nucleus, a naphthoxaoline nucleus, a benzimidazoline nucleus, a dihydroimidazolopyrimidine nucleus, dihydrotriazolopyridine, and a dihydrotriazolopyrimidine nucleus are included.

These heterocyclic condensed ring nuclei may have various types of substituents. The substituents include, in addition to those mentioned as substituents on the aryl group represented by $R_5$ and $R_6$, an alkylthio group (e.g., ethylthio), a substituted or unsubstituted amino group (e.g., methylamino, diethylamino, benzylamino, and anilino), an acylamino group (e.g., acetylamino and benzoylamino), a sulfonamido group (e.g., methanesulfonamido and p-toluenesulfonamido), a thioamido group (e.g., propypionylthioamido), an alkenyl group having 2 to 20 carbon atoms (e.g., allyl), an aralkyl group whose alkyl moiety has 1 to 4 carbon atoms (e.g., benzyl), a cyano group, a carbamoyl group (including a substituted one, e.g., methylcarbamoyl), an alkoxycarbonyl group having 2 to 22 carbon atoms (e.g., butoxycarbonyl), and an alkylcarbonyl group having 2 to 22 carbon atoms (e.g., caproyl).

Said alkyl group may be substituted, for example, by a carboxyl group, a sulfo group, an alkoxycarbonyl group, an acyloxy group, or an aryl group.

The above-mentioned compounds can be synthesized, for example, by methods described in JP-B No. 34169/1973, *Yakugaku Zasshi* No. 74, pages 1365 to 1369 (1954), JP-B No. 23368/1974, *Beilstein* XII, page 394, and IV, page 121, and JP-B No. 18008/1972.

Of the compounds represented by formula (III), preferable specific examples are given below, but the present invention is not limited to them.

(III-1)

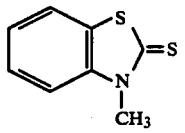

-continued (III-2)

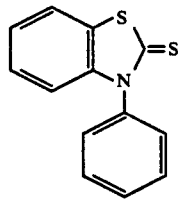

(III-3)

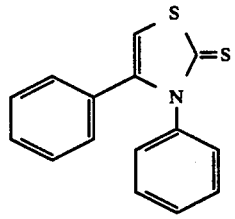

(III-4)

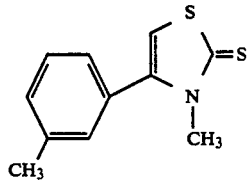

(III-5)

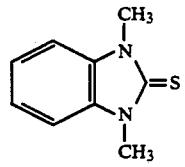

(III-6)

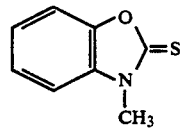

(III-7)

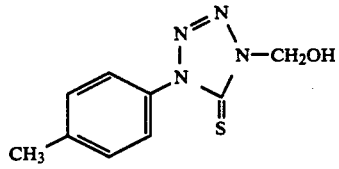

(III-8)

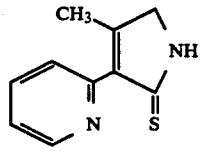

(III-9)

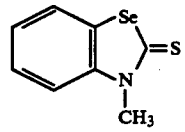

(III-10)

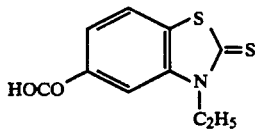

-continued (III-11)

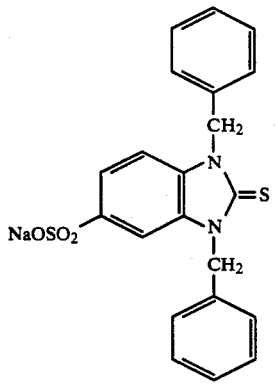

(III-12)

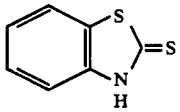

(III-13)

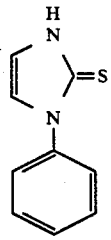

(III-14)

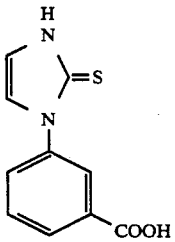

(III-15)

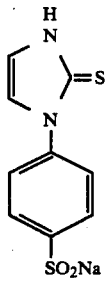

-continued (III-16)

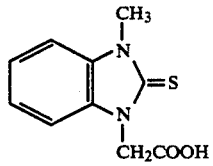

(III-17)

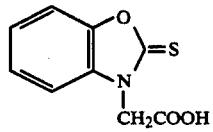

(III-18)

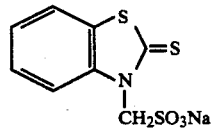

(III-19)

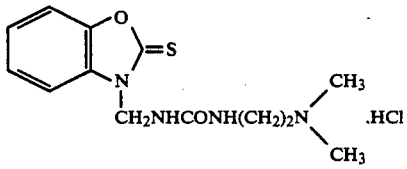

(III-20)

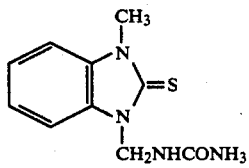

Compounds having repeating units represented by formula (IV) will now be described in detail.

Formula (IV)

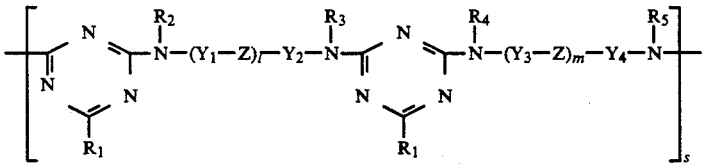

wherein $H_1$ represents —OR, —SR,

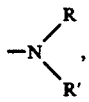

in which R and R′ each represent a hydrogen atom, an alkyl group having 1 to 12 carbon atoms, a hydroxyalkyl group, a sulfoalkyl (or its salt) group, a carboxylalkyl (or its salt) group, an aralkyl group, an aryl group having 6 to 12 carbon atoms that may have a sulfo (or its salt), carboxy (or its salt), $C_1$ to $C_4$ alkyl, $C_1$ to $C_4$ alkoxy or halogen substituent, or a cycloalkyl group, or R and R′ may together form an alkylene ring that may include —O—, $R_2$, $R_3$, $R_4$, and $R_5$, where each represents a hydrogen atom or an alkyl group having 1 to 4 carbon atoms; $Y_1$, $Y_2$, $Y_3$, and $Y_4$ each represent a polymethylene group having 2 to 12 carbon atoms that may be substituted by an alkyl group having 1 to 4 carbon atoms, an allylen group that may have a sulfo (or its salt), carboxyl (or its salt), $C_1$ to $C_4$ alkyl or halogen substituent, or a cycloalkylene group; Z represents —O—, —$SO_2$—, or —$CH_2$—; l and m each are 0 or 1; and s is 2 to 100.

Compounds having repeating units represented by formula (IV) of the present invention are known per se, and can be synthesized easily in accordance with the method described in JP-B No. 15471/1971.

Typical examples of compounds having repeating units represented by formula (IV) that are used in the present invention are given below, but the present invention is not limited to them.

(IV-1)

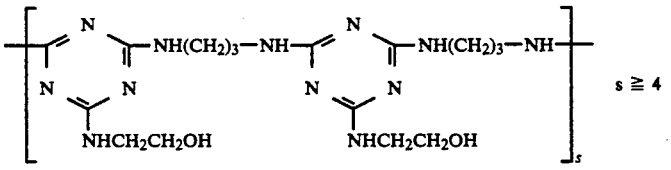

s represents the number of repeating unit. The same rule applies corresponding to the following.

(IV-2)

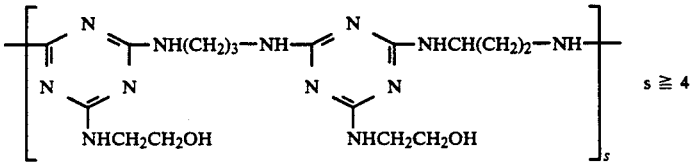

(IV-3)

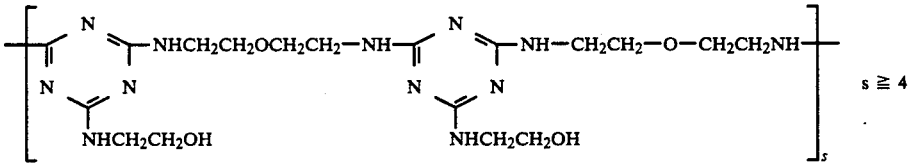

(IV-4)

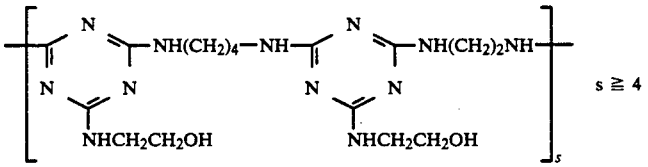

(IV-5)

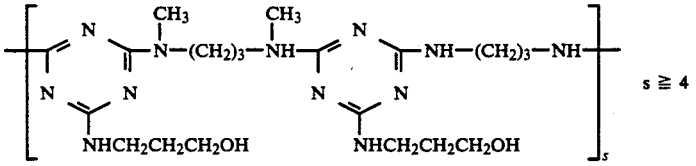

(IV-6)

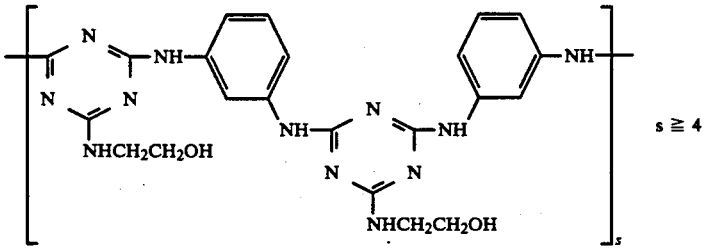

(IV-7)

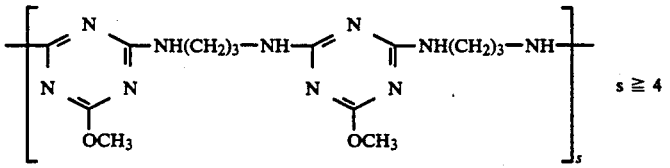

-continued
(IV-8)
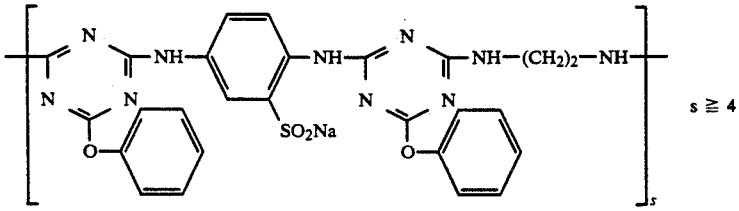
(IV-9)
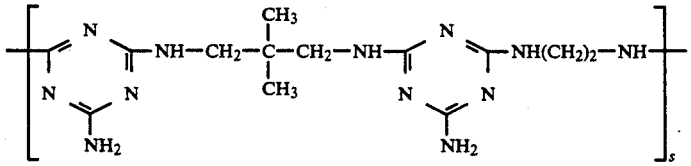
(IV-10)
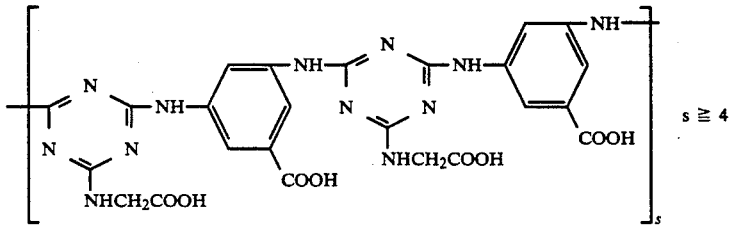
(IV-11)
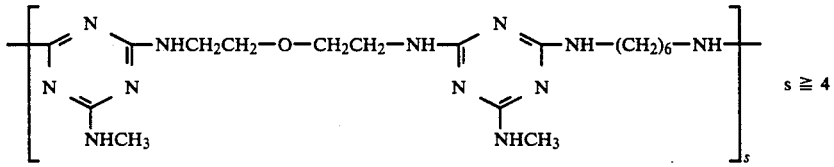
(IV-12)
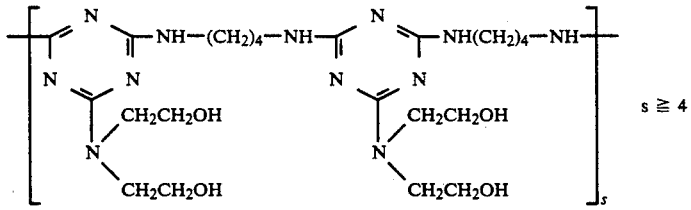
(IV-13)
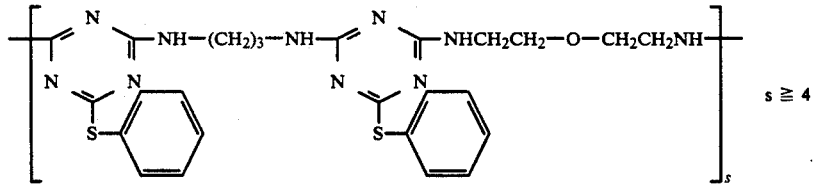
(IV-14)
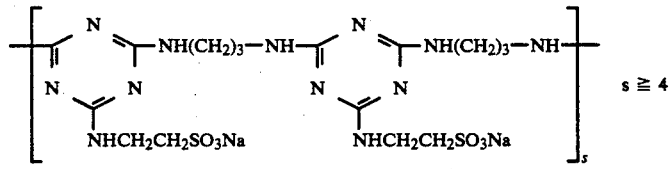
(IV-15)
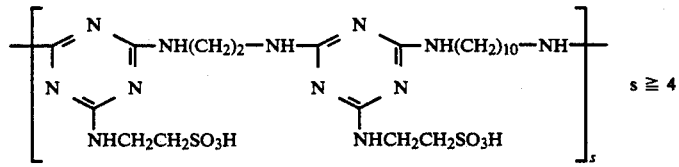

-continued
(IV-16)
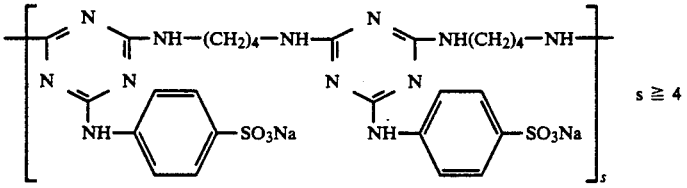
(IV-17)
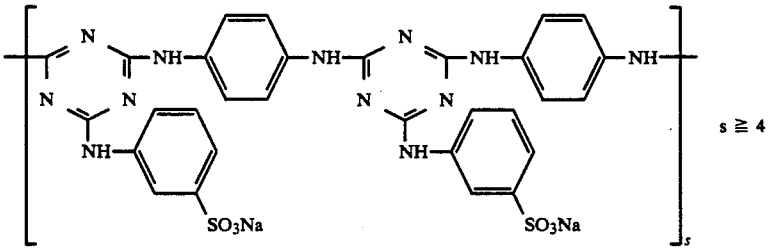
(IV-18)
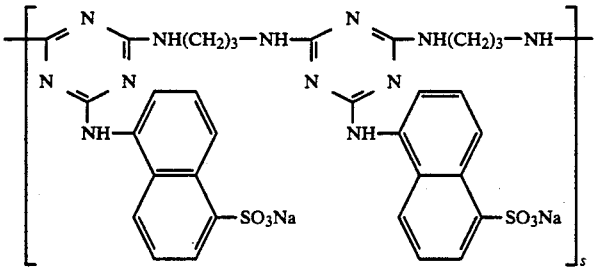
(IV-19)
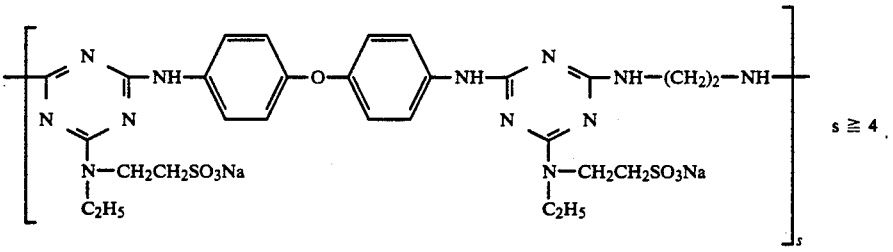
(IV-20)
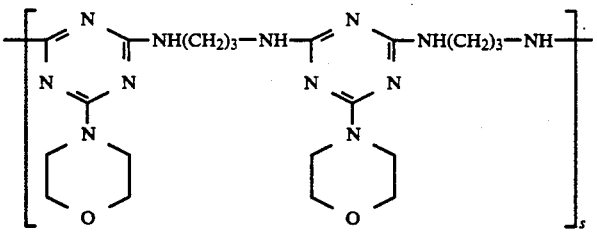
(IV-21)
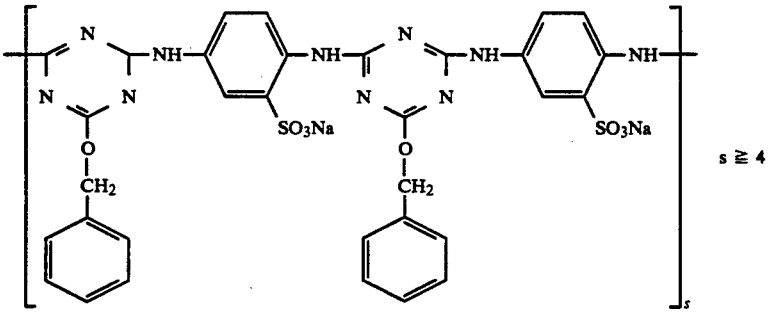

-continued
(IV-22)
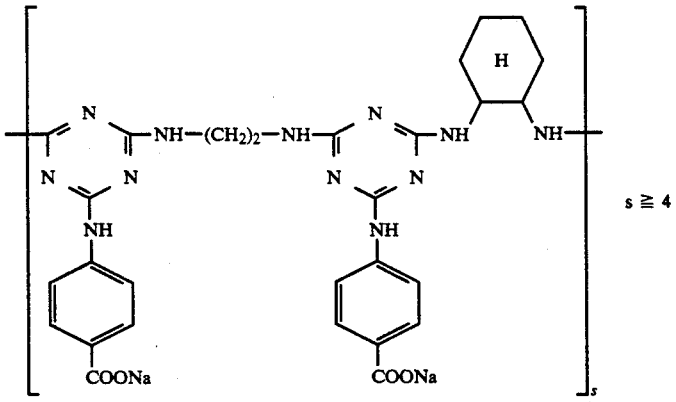
s ≧ 4
(IV-23)
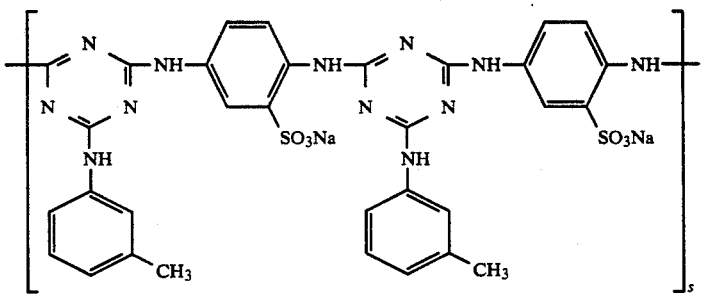
s ≧ 4
(IV-24)
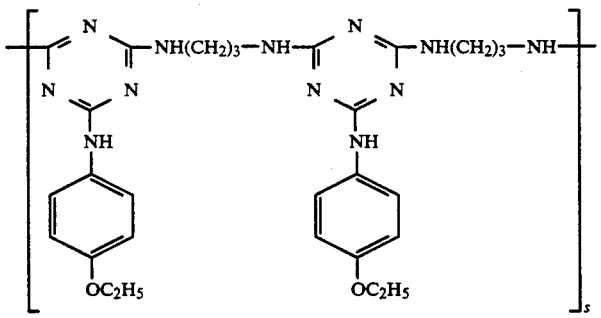
s ≧ 4
(IV-25)
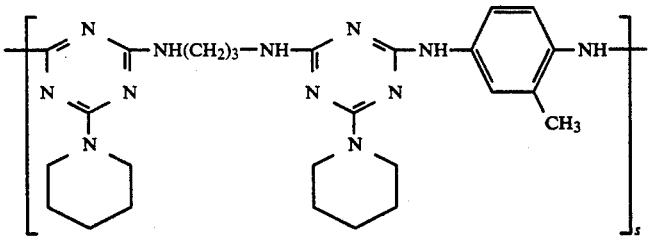
s ≧ 4
(IV-26)
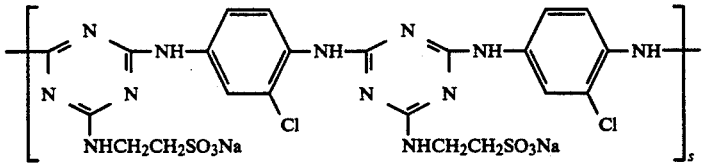
s ≧ 4
(IV-27)
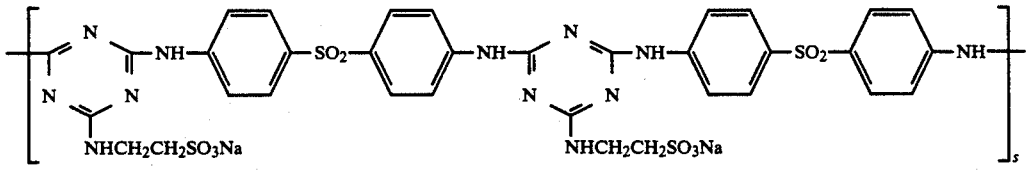
s ≧ 4

-continued

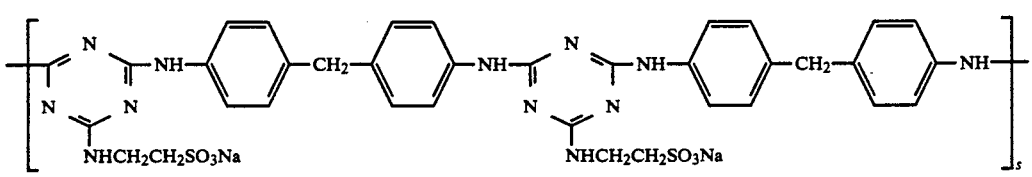

(IV-28)

$s \geqq 4$

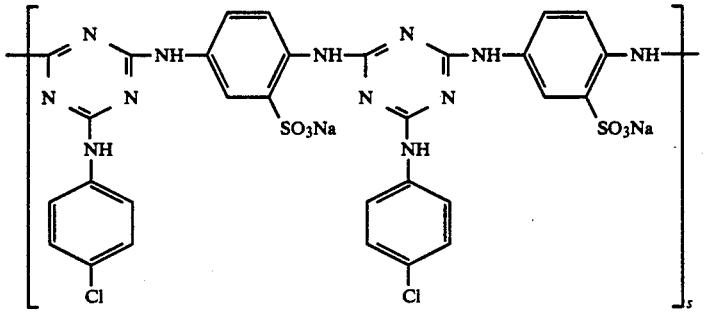

(IV-29)

$s \geqq 4$

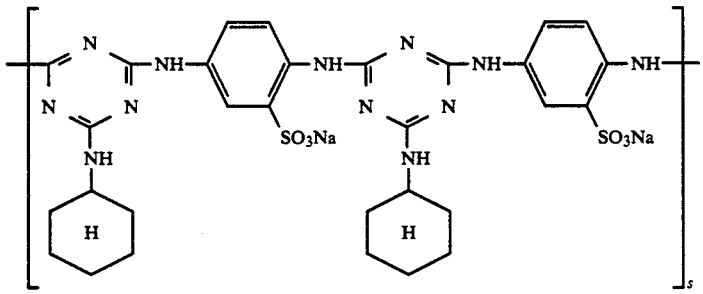

(IV-30)

$s \geqq 4$

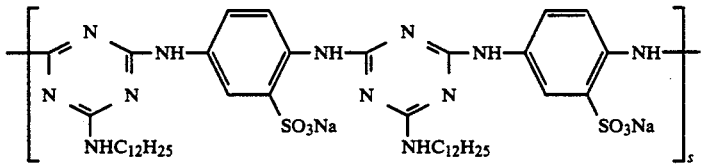

(IV-31)

$s \geqq 4$

Compounds represented by formula (V) will now be described in detail below.

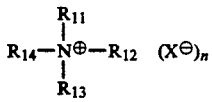

Formula (V)

wherein $R_{11}$ to $R_{14}$ each represent an alkyl group, an aryl group, or an aralkyl group, provided that the total number of carbon atoms included in $R_{11}$ to $R_{14}$ is 6 or over; $R_{11}$, $R_{12}$, and $R_{13}$ may together form a heterocyclic ring, including quaternary nitrogen; X represents an anion., and n is 1, except that when the compound forms an inner salt, n is 0.

In particular, $R_{11}$ to $R_{14}$ each represent an alkyl group having up to 30 carbon atoms (e.g., methyl, ethyl, n-butyl, n-hexyl, and n-dodecyl), an aryl having up to 30 carbon atoms (e.g., phenyl, naphthyl, tolyl, and p-ethylphenyl), or an aralkyl having up to 30 carbon atoms (e.g., benzyl and phenethyl), and the total number of carbon atoms in $R_{11}$ to $R_{14}$ is selected to be 6 or over.

A compound represented by the following formula (Va) or its dimer is preferable:

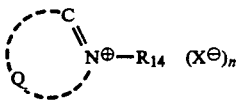

Formula (Va)

wherein Q represents a heterocyclic ring, including quaternary nitrogen, such as a pyridinium ring, a thiazolium ring, a benzthiazolium ring, and a benzimidazolium ring, which ring may be substituted by an alkyl group (e.g., methyl, ethyl, n-hexyl, hydroxyethyl, and carboxyethyl), an alkenyl group (e.g., allyl), an aralkyl group (e.g., benzyl and phenethyl), an aryl group (e.g., phenyl, naphthyl, p-acetamidophenyl, p-carboxyphenyl, m-hydroxyphenyl, p-sulfamoylphenyl, p-acetylphenyl, o-methoxyphenyl, 2,4-diethylaminbphenyl, and 2,4-dichlorophenyl), an alkylthio group (e.g., methylthio, ethylthio, and n-butylthio), an arylthio group (e.g., phenylthio and naphthylthio), or an aralkylthio group (e.g., benzylthio), and if condensed rings they may be substituted by a substituent of those mentioned above or a nitro group, an amino group, a halogen atom, a carboxyl group, or a sulfo group, and $R_4$, X, and n have the same meaning as defined above.

The dimer of formula (V) (including formula (Va)) is one formed by connecting two molecules of a compound represented by formula (V) via a divalent group such as an alkylene group or an arylene group.

The compounds represented by formula (V) of the present invention are all known compounds, and they can be readily obtained or synthesized.

Of the compounds represented by formula (V), preferable specific examples are given below, but the present invention is not limited to them.

(V-1)

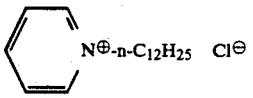

(V-2)

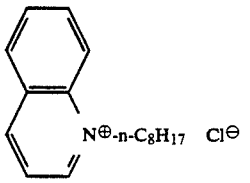

(V-3)

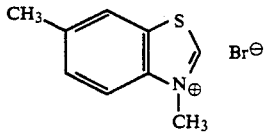

(V-4)

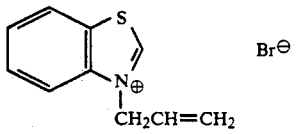

(V-5)

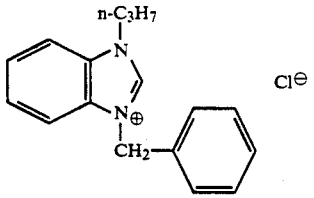

(V-6)

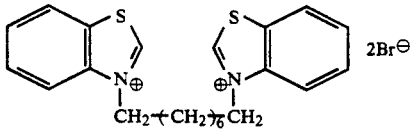

(V-7)

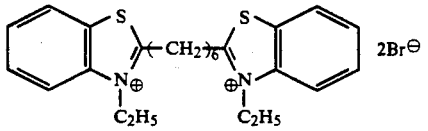

(V-8)

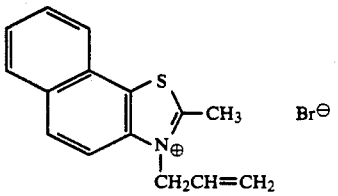

-continued (V-9)

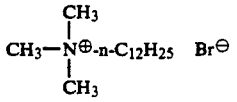

Next, compounds represented by formula (VI) are described in detail below.

Formula (VI)

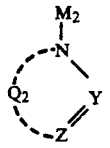

wherein Y and Z each independently represent methine, substituted methine, or a nitrogen atom, $Q_2$ represents a group of atoms required to form a 5- or 6-membered heterocyclic ring, which may be condensed, and $M_2$ represents a hydrogen atom or a cation such as an alkali metal cation and an ammonium ion.

As the ring formed by $Q_2$ can be mentioned triazole, tetrazole, imidazole, oxazole, thiadiazole, pyridine, pyrimidine, triazine, azabenzimidazole, purine, tetraazaindene, triazaindene, pentaazaindene, benztriazole, benzimidazole, benzoxazole, benzthiazole, benzselenazole, indazole, and naphthoimidazole.

These rings may be further substituted, for example, by an alkyl group (e.g., methyl, ethyl, n-hexyl, hydroxyethyl, and carboxyethyl), an alkenyl group (e.g., allyl), an aralkyl group (e.g., benzyl and phenethyl), an aryl group (e.g., phenyl, naphthyl, p-acetamidophenyl, p-carboxyphenyl, m-hydroxyphenyl, p-sulfamoylphenyl, p-acetylphenyl, o-methoxyphenyl, 2,4-diethylaminophenyl, and 2,4-dichlorophenyl), an alkylthio group (e.g., methylthio, ethylthio, and n-butylthio), an arylthio group (e.g., phenylthio and naphthylthio), or an aralkylthio group (e.g., benzylthio). The condensed ring may be substituted, for example, by a substituent, such as those substituents mentioned above or a nitro group, an amino group, a halogen atom, a carboxyl group, or a sulfo group.

The compounds represented by formula (VI) of the present invention are all known compounds, and they can be readily obtained or synthesized.

Of the compounds represented by formula (VI), preferable specific examples are given below, but the present invention is not limited to them.

(VI-1)

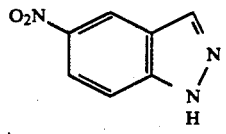

(VI-2)

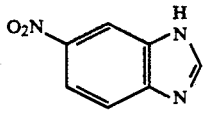

(VI-3)

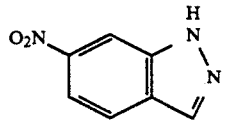

-continued (VI-4)

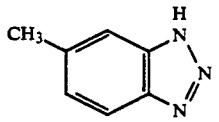

(VI-5)

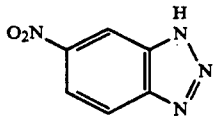

(VI-6)

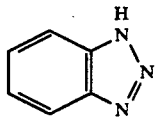

(VI-7)

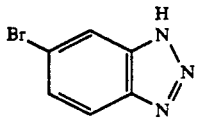

(VI-8)

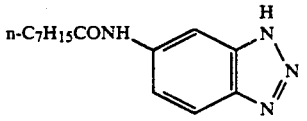

(VI-9)

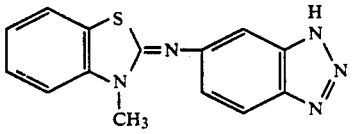

(VI-10)

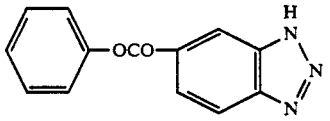

(VI-11)

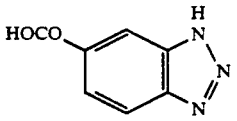

(VI-12)

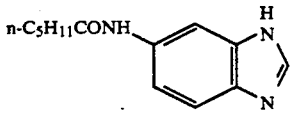

(VI-13)

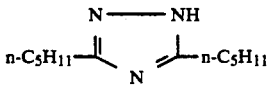

(VI-14)

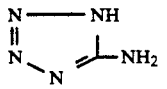

(VI-15)

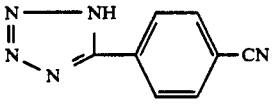

-continued (VI-16)

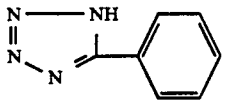

The compound of the present invention represented by formula (II), (III), (IV), (V), or (VI) is used in an amount of $10^{-1}$ to $10^{-6}$ mol, preferably $5\times10^{-2}$ to $3\times10^{-5}$ per mol of a silver halide present in the same layer or in the adjacent layer, although the amount varies depending on the properties or the purpose of the silver halide photographic material to which the particular compound is applied, or on the method of the developing process.

To introduce the compound represented by formula (II), (III), (VI), (V), or (VI) into a photographic material, the compound is dissolved into a solvent that is usually used in photographic materials, such as water, methanol, ethanol, propanol, or a fluorinated alcohol, and the solution is added to a hydrophilic colloid. When the compound is to be included in a silver halide emulsion layer, it may be included therein when the grains of the silver halide emulsion are formed, or at the time of physical ripening, or immediately before, during, or after chemical sensitization, or at the time when a coating solution is prepared, which will be selected depending on the purpose.

The photographic material to which the present invention is applied may be color reversal photographic materials of any of color reversal film (of the coupler-in-emulsion type or of the coupler-in-developer type), and color reversal paper.

Any of silver halides of silver bromide, silver bromoiodide, silver bromochloroiodide, silver chlorobromide, and silver chloride can be used in combination in the photographic emulsion layer of the photographic material used in the present invention. The grains of the silver halide may be so-called regular grains that are in the shape of regular crystals, such as cubes, octahedrons, and tetradecahedrons, or grains that are in the shape of irregular crystals, such as tabular grains or spherical grains, or grains that are crystals having crystal defects such as twin planes, or composite grains thereof. A mixture of grains different in crystalline form can also be used.

The grain diameter of the silver halide may be fine grains of about 0.1 μm or less, or coarse grains wherein the diameter of the projected area is about 10 μm or less, and a monodisperse emulsion having a narrow distribution or a polydisperse emulsion having a wide dispersion can be used.

The silver halide photographic emulsions that can be used in the present invention can be produced suitably by known means, for example by the methods described in *I. Emulsion Preparation and Types, Research Disclosure,* Vol. 176, No. 17643 (December 1978), pages 22-23, and in ibid., Vol, 187, No. 18716 (november 1979), page 648.

The photographic emulsions used in the present invention may be suitably prepared by using the methods described in P. Glafkides, in *Chimie et Physique Photographique,* Paul Montel (1967), in G. F. Duffin, *Photographic Emulsion Chemistry,* Focal Press (1966), in V. L. Zelikman et al., *Making and Coating Photographic Emulsions,* Focal Press (1964), etc. That is, any one of the acid, neutral, ammonia methods, etc. can be used; and to react a soluble silver salt with a soluble halide, any one of the single-jet or double-jet methods, or a combination of these, etc. can be used. A method where grains are formed in the presence of an excess of silver ions, the so-called reverse mixing method, can be used. As one type of double-jet method, the so-called controlled double-jet method can be used, where the pAg in the liquid phase where a silver halide is to be produced is kept constant. According to this method, a silver halide emulsion can be obtained where the crystal form is regular and the grain size is uniform.

A silver halide emulsion comprising regular grains used in the present invention can be obtained by controlling the pAg and the pH during the formation of the grains. Details are described, for example, in *Photographic Science and Engineering*, Vol. 6, pages 159–165 (1962), *Journal of Photographic Science*, Vol. 12, pages 242–251 (1964), and in U.S. Pat. No. 3,655,394 and British Patent No. 1,413,748.

Methods of producing such an emulsion are disclosed in U.S. Pat. Nos. 3,574,628 and 3,655,394 and British Patent No. 1,413,748. Monodisperse emulsions are described, for example, in JP-A Nos. 8600/1973, 39027/1976, 83097/1976, 137133/1978, 48521/1979, 99419/1979, 37635/1983, and 49938/1983 can be preferably used in the present invention.

The crystal structure of the emulsion grains may be uniform, or the outer halogen composition of the crystal structure may be different from the inner halogen composition, or the crystal structure may be layered. These emulsion grains are disclosed, for example, in British Patent No. 1,027,146, U.S. Pat. Nos. 3,505,068 and 4,444,877, and JP-A No. 143331/1985. Silver halides whose compositions are different may be joined by the epitaxial joint, or a silver halide may be joined, for example, to a compound other than silver halides, such as silver rhodanide, lead oxide, etc. These emulsion grains are disclosed in U.S. Pat. Nos. 4,094,684, 4,142,900, and 4,459,353, British Patent No. 2,038,792, U.S. Pat. Nos. 4,349,622, 4,395,478, 4,433,501, 4,463,087, 3,656,962, and 3,852,067, JP-A No. 162540/1984, etc.

In the process of the formation or physical ripening of silver halide grains, a cadmium salt, a zinc salt, a lead salt, a thallium salt, and iridium salt or its complex salt, a rhodium salt or its complex salt, an iron salt or its complex salt, or the like may also be present.

These various emulsions may be of a surface latent image type, wherein the latent image is mainly formed on the surface, or of an internal latent image type, wherein the latent image is formed in the grains, To remove the soluble silver salt from the emulsion before or after physical ripening, a noodle-washing method, flocculation setting method, ultrafiltration method, or the like will be performed.

Generally the emulsion to be used in the present invention may be chemically ripened and spectrally sensitized after physical ripening. Additives that will be used in these steps are described in *Research Disclosure* No. 17643 (December 1978) and No. 18716 (November 1979), and the involved sections are listed in the Table below.

Known photographic additives that can be used in the present invention are also described in *Research Disclosure* Nos. 17643 and 18716, and the involved sections are given in the Table below.

| | Additive | RD 17643 | RD 18716 |
|---|---|---|---|
| 1 | Chemical sensitizer | p. 23 | p. 648 (right column) |
| 2 | Sensitivity-enhancing agents | — | " |
| 3 | Spectral sensitizers and Supersensitizers | pp. 23–24 | pp. 648 (right column) -649 (right column) |
| 4 | Brightening agents | p. 24 | — |
| 5 | Antifogging agents | pp. 24–25 | p. 649 (right column) |
| 6 | Light absorbers, Filter dyes, and UV Absorbers | pp. 25–26 | pp. 649 (right column) -650 (left column) |
| 7 | Stain-preventing agents | p. 25 (right column) | p. 650 (left to right column) |
| 8 | Image-dye stabilizers | p. 25 | — |
| 9 | Hardeners | p. 26 | p. 651 (left column) |
| 10 | Binders | p. 26 | " |
| 11 | Plasticizers and Lubricants | p. 27 | p. 650 (right column) |
| 12 | Coating aids and Surface-active agents | pp. 26–27 | " |
| 13 | Antistatic agents | p. 27 | " |

Various color couplers can be used in the present invention, and examples thereof are described in patents cited in *Research Disclosure* No. 17643, VII-C to G. As dye forming couplers, couplers capable of developing three primary colors of the substractive color process (i.e., yellow, magents, and cyan) by color development are important, specific examples of hydrophobic 4-equivalent or 2-equivalent couplers that have been made nondiffusible are couplers disclosed in patents cited in *Research Disclosure* No. 17643, VII-C and VII-D. In addition the following couplers can be used favorably in the present invention.

Representative examples of yellow couplers useful in this invention include couplers of the oil-protected (hydrophobically ballasted) acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group, as illustrated in U.S. Pat. Nos. 3,408,194, 3,447,928, 3,933,501, and 4,022,620; yellow couplers having a nitrogen-linked coupling-off group, as illustrated in JP-B No. 10739/1983, U.S. Pat. Nos. 4,401,752 and 4,326,024, *Research Disclosure* No. 18053 (April 1979) British Patent No. 1,425,020, and German Patent (OLS) Nos. 2,219,917, 2,261,361, and 2,433,812. Couplers of the α-pivaloylacetoanilide type are superior in the fastness of formed dyes, particularly on exposure to light, while couplers of the α-benzoylacetoanilide type are capable of forming high maximum density.

Magenta couplers useful for this invention include hydrophobic and ballasted couplers of the indazolone or cyanoacetyl type, preferably of the 5-pyrazolone or pyrazoloazole (e.g., pyrazolotriazole) type. 5-Pyrazolones substituted by an arylamino or acylamino group at the 3-position are preferable in view of the hue and maximum densities of formed dyes, and are illustrated in U.S. Pat. Nos. 2,311,082, 2,343,703, 2,600,788, 2,908,573, 3,062,653, 3,152,896, and 3,936,015. Preferable coupling split-off groups in the two-equivalent 5-pyrazolone couplers are nitrogen-linked coupling split-off groups described in U.S. Pat. No. 4,310,619, and an arylthio group described in U.S. Pat. No. 4,351,897. The ballast groups described in European Patent No. 73,636 have effects to enhance developed density in the 5-pyrazolone couplers.

Examples of pyrazoloazole couplers include pyrazolobenzimidazole described in U.S. Pat. No. 3,061,432, more preferably pyrazolo [5,1-c] [1,2,4] triazoles described in U.S. Pat. No. 3,725,067, pyrazolotetrazoles described in *Research Disclosure* No. 24220 (June 1984) and JP-A No. 33552/1985, and pyrazolopyrazole described in *Research Disclosure* No. 24230 (June 1984) and JP-A No. 3659/1985. Imidazo [1,2] pyrazoles described in U.S. Pat. No. 4,500,630 are preferable with respect to the reduced yellow side-absorption and fastness of developed dyes on exposure to light, and pyrazolo [1,5-b] [1,2,4] -triazoles described in European Patent No. 119,860 A are particularly preferable.

Cyan couplers that can be used in this invention include ballasted and hydrophobic naphthol couplers and phenol couplers. An example of naphthol couplers is disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of phenol couplers are those disclosed in U.S. Pat. Nos. 2,369,929, 4,228,233, and 4,296,200. Examples of phenol couplers are those disclosed in U.S. Pat. Nos. 2,369,929, 2,801,171, 2,772,162, and 2,895,826, and JP-A No. 55340/1985.

Examples of cyan couplers stable to moisture and heat that can be advantageously used in this invention include phenol cyan couplers having a higher alkyl group than methyl group at the meta position of the phenol nucleus, as disclosed in U.S. Pat. No. 3,772,002, 2,5-diacylamino-substituted phenol cyan couplers disclosed in U.S. Pat. Nos. 2,772,162, 3,758,308, 4,126,396, 4,334,011, 4,527,173, German Patent (OLS) 3,329,729, and European Patent No. 121,365, and phenol cyan couplers having a phenylureido group at the 2-position and an acylamino group at the 5-position disclosed in U.S. Pat. Nos. 3,446,622, 4,333,999, 4,451,559, and 4,427,767.

The dye-forming couplers and the special couplers described above may be dimeric, oligomeric, or polymeric. Examples of polymerized dye-forming couplers are disclosed in U.S. Pat. Nos. 3,451,820 and 4,080,211. Examples of polymerized magenta couplers are disclosed in British Patent No. 2,102,173 and U.S. Pat. No. 4,367,282.

Couplers that will release a photographically useful residue along with the coupling reaction can also be used preferably in the present invention. As DIR couplers that will release a development restrainer, couplers described in patents described in *Research Disclosure* No. 17643, VII-F are useful.

Those that are preferable for combination with the present invention are developing-solution-deactivating-type couplers described, for example, in JP-A No. 151944/1982, timing-type couplers described, for example, U.S. Pat. No. 4,248,962 and JP-A No. 154234/1982, reactive-type couplers described, for example, in JP-A No. 184248/1985, and, particularly preferably, developing-solution-deactivating-type DIR couplers described, for example, in JP-A Nos. 151944/1982, 217932/1983, 218644/1985, 225156/1985, and 233650/1985, and reactive DIR couplers described, for example, in JP-A No. 184248/1985.

Couplers that can be used in the present invention can be introduced into a photographic material by any one of various known dispersing methods, typically, for example, by the solid dispersing method, the alkali dispersing method, or preferably the latex dispersing method, or most preferably the oil-in-water dispersion method. In the oil-in-water dispersing method, after the coupler is dissolved in one or a combination of a high-boiling organic solvent (with a boiling point of 175° C. or higher) and a low-boiling so-called auxiliary-solvent, the mixture is dispersed finely into an aqueous medium, such as a gelatin solution, or into water in the presence of a surface-active agent. Examples of high-boiling organic solvents are described in U.S. Pat. No. 2,322,027, etc. Dispersion may be accompanied by phase reversal of the emulsion, and, if required, the auxiliary-solvent is removed or decreased by distillation, noodle washing, ultrafiltration, or the like, followed by application.

Regarding the process of the latex dispersion method, the effect thereof and specific examples of latexes for impregnation are described, for example, in U.S. Pat. No. 4,199,363 and West German application (OLS) Nos. 2,541,274 and 2,541,230.

The photographic materials used in the present invention may contain, as a color-fog-preventing agent or color-mix-preventing agent, hydroquinone derivatives, aminophenol derivatives, amines, gallic acid derivatives, catechol derivatives, ascorbic acid derivatives, colorless couplers, and sulfonamidophenol derivatives.

The photographic materials used in the present invention can include various discoloration-preventing agents. Typical examples of organic discoloration-preventing agents are hydroquinones, 6-hydroxychromans, 5-hydroxycoumarans, spirochromans, p-alkoxyphenols, hindered phenols, including bisphenols, gallic acid derivatives, methylenedioxybenzenes, aminophenols, hindered amines, and ether or ester derivatives, wherein the phenolic hydroxyl group of these compounds is silylated or alkylated. Metal complexes such as (bis-salicylaldoxymato)nickel complex and (bix-N,N-dialkyldithiocarbamato)nickel complexes can also be used.

The color reversal photographic material to which the present invention can be applied may be multilayer, multicolor photographic materials having at least two different spectral sensitivities on a base. Generally, a multilayer color photographic material has at least one red-sensitive emulsion layer, at least one green-sensitive emulsion layer, and at least one blue-sensitive emulsion layer on a base. The order of these layers is arbitrarily selected as desired. A preferable order of the layers is such that the red-sensitive emulsion layer, the green-sensitive emulsion layer, and the blue-sensitive emulsion layer are arranged from the base side, or that the blue-sensitive emulsion layer, the red-sensitive emulsion layer, and the green-sensitive emulsion layer are arranged from the base side. Each of these emulsion layers may consist of two or more emulsion layers of different sensitivity, or it may consist of two or more emulsion layers having the same sensitivity with a non-photosensitive layer between them. Generally, the red-sensitive emulsion layer contains a cyan-forming coupler, the green-sensitive emulsion layer contains a magenta-forming coupler, and the blue-sensitive emulsion layer contains a yellow-forming coupler, but in some cases the combination can be changed.

It is preferable that the photographic material according to the present invention is provided, in addition to the silver halide emulsion layers, with suitable auxiliary layers, such as a protective layer, an intermediate layer, a filter layer, an antihalation layer. and a backing layer.

In the photographic materials of the present invention, the photographic emulsion layers and other layers are applied on a generally flexible base of plastic film, paper, or cloth, or on a rigid base of glass, porcelain, or metal. Useful flexible bases include films made of cellulose derivatives (e.g., nitrocellulose, cellulose acetate, cellulose acetylate butyrate), synthetic polymers (e.g., polystyrene, polyvinyl chloride, polyethylene terephthalate, and polycarbonate), or paper coated or laminated with a baryta layer or an $\alpha$-olefin polymer (e.g., polyethylene, polypropylene, and ethylene/butene copolymer). Bases may be colored with a dye or a pigment, or may be made black to shield light. Generally the surface of the bases is subjected to an undercoat treatment to assure favorable adhesion to the photographic emulsion layers. The base surface may be subjected to glow discharge, corona discharge, ultraviolet irradiation, flame treatment, or the like, before or after the undercoat treatment.

To apply the photographic emulsion layers and other hydrophilic colloid layers, such known coating methods as the dip coating method, the roller coating method, the curtain coating method, and the extrusion coating method can be used. If required the layers may be applied simultaneously by coating methods described in U.S. Pat. Nos. 2,681,294, 2,761,791, 3,526,628, and 3,508,947.

The color-developing solution to be used in the developing process of the photographic material of the present invention is preferably an aqueous alkaline solution whose major component is an aromatic primary amine-type color developing agent. As the color developing agent, aminophenol-type compounds are useful, and p-phenylenediamine-type compounds are preferably used, typical examples thereof being 3-methyl-4-amino-N,N-diethylaniline, 3-methyl-4-amino-N-ethyl-N-$\beta$-hydroxylaniline, 3-methyl-4-amino-N-ethyl-N-$\beta$-methanesulfonamidoethylaniline, and 3-methyl-4-amino-N-ethyl-N-$\beta$-methoxyethylaniline and their sulfates, and hydrochlorides or p-toluenesulfonates. These compounds may be used in combination according to the purpose.

Generally the color-developing solution contains pH buffers such as carbonates, borates, or phosphates of alkali metals; antifoggants or development retarders, such as mercapto compounds, benzothiazoles, benzimidazoles, iodides or bromides; and if required, preservatives such as hydroxylamine, diethylhydroxylamine, sulfites, hydrazines, phenylsemicarbazides, triethanolamine, catecholsulfonic acids, and triethylenediamine(1,4-diazabicyclo [2,2,2] octane); organic solvents such as ethylene glycol and diethylene glycol., development accelerators such as benzyl alcohol, polyethylene glycol, quaternary ammonium salts, and amines; dye-forming couplers; competing couplers, fogging agents such as sodium boron hydride; auxiliary developing agents such as 1-phenyl-3-pyrazolidone., thickening agents; and chelate agents, such as aminopolycarboxylic acids, aminopolyphosphonic acids, alkylphosphonic acids, and phosphonocarboxylic acids such as, for example, ethylenediaminetetraacetic acid, nitrilotriacetic acid, diethylenetriaminetetraacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di-(o-hydroxyphenylacetic acid), and their salts.

For reversal processing, a color development is generally carried out after a black-and-white development. For the black-and-white developing solution, known black-and-white-developing agents such as dihydroxybenzenes (e.g., hydroquinone), 3-pyrazolidones (e.g., 1-phenyl-3-pyrazolidone), and aminophenols (e.g., N-methyl-p-aminophenol) may be used alone or in combination with others.

Generally the color-developing solution has a pH of 9 to 12. Although the replenishing amount of the developing solution varies depending on the color photographic material to be processed, generally the replenishing amount is 3l or below per $m^2$ of the photographic material, and the replenishing amount can be lowered to 500 ml or below if the bromide ion concentration of the replenishing solution is lowered. If it is required to lower the replenishing amount, it is preferable that the area of the processing tank in contact with air is minimized to prevent the solution from evaporating or being oxidized by air. The replenishing amount can also be lowered by suppressing the accumulation of bromide ions in the developing solution.

The photographic emulsion layers are generally subjected to a bleaching process after color development.

The bleaching process can be carried out together with the fixing process (bleach-fixing process), or it can be carried out separately from the fixing process. Further, to quicken the process, bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process. As the bleaching agent, use can be made of, for example, compounds of polyvalent metals, such as iron (III), cobalt (111), chromium (VI), and copper (II), peracids, quinones, and nitro compounds. As typical bleaching agents, use can be made of ferricyanides; dichromates; organic complex salts of iron (II) or cobalt (III), such as complex salts of aminopolycarboxylic acids, for example ethylenediaminetetraacetic acid, diethylenetriaminetetraacetic acid, cyclohexadiaminetetraacetic acid, methyliminodiacetic acid, 1,3-diaminopropinacetic acid, and glycol ether diamine tetraacetic acid, citric acid, tartaric acid, and malic acid; persulfates; bromates; permanganates; and nitrobenzenes. Of these, aminopolycarboxylic acid iron (III) complex salts, including ethylenediaminetetraacetic acid iron (III) complex salts, including ethylenediaminetetraacetic acid iron (III) complex salt, and persulfates are preferable in view of rapid processing and the prevention of environmental pollution. Further, aminopolycarboxylic acid iron (III) complex salts are particularly useful in a bleaching solution as well as a bleach-fix solution. The pH of the bleaching solution or the bleach-fix solution using these aminopolycarboxylic acid iron (III) complex salts is generally 5.5 to 8, but if it is required to quicken the process,the process, the process can be effected at a lower pH.

In the bleaching solution, the bleach-fix solution, and the baths preceding them a bleach-accelerating solution may be used if necessary. Examples of useful bleach-accelerating agents are compounds having a mercapto group or a disulfide linkage, described in U.S. Pat. No. 3,893,858, West German Patent No. 1,290,812, JP-A No. 95630/1978, and *Research Disclosure* No. 17129 (June 1978); thiazolidine derivatives, described in JP-A No. 140129/1975; thiourea derivatives, described in U.S. Pat. No. 3,706,561; iodide salts, described in JP-A No. 6235/1983; polyoxyethylene compounds, described in West German Patent No. 2,748,430; polyamine compounds, described in JP-B No. 8836/1960; and iodide ions. Of these, compounds having a mercapto group or a disulfide group arc preferable in view of higher acceleration effect, and in particular, compounds described in U.S. Pat. No. 3,893,858, West German Patent No. 1,290,812, and JP-A No. 95630/1978 are preferable. Compounds described in U.S. Pat. No. 4,552,834 are preferable. These bleach-accelerating agents may be added into the photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, though the use of thiosulfates is common, and particularly ammonium thiosulfate can be used most widely. It is preferable to use, as a preservative for the bleach fix solution, sulfites, bisulfites, and carbonyl bisulfite adducts.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number of steps), the type of replenishing system, including, for example, the counter-current system and the direct flow system, and other various conditions. Of these, the relationship between the number of water-washing tanks and the amount of washing water in the multi-stage counter-current system can be found according to the method described in *Journal of the Society of Motion Picture and Television Engineers,* Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem, the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshio Horiguchi in "*Bokin/bobaizai no Kagaku,*" edited by Eiseigijutsu-kai, and in "*Bokin Bobaizai Jiten*", edited by Nihon Bokin Bobai-Gakkai, can be used.

The pH of the washing water used in processing the present photographic material is 4 to 9, preferably 5 to 8. The washing water temperature and the washing time to be set may vary depending, for example, on the characteristics and the application of the photographic material, and they are generally selected in the range of 15° to 45° C. for 20 sec. to 10 min., and preferably in the range of 25° to 40° C. for 30 sec. to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985, and an ion-exchanging process can be used.

In some cases, the above washing process is further followed by a stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flowed solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for a color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolidones. Typical compounds are described in JP-A No. 64339/1981, 144547/1982, and 115438/1983.

The various processing solutions used for the present invention are used at 10° to 50° C. Although generally a temperature of 33° to 38° C. is standard, a higher temperature can be used to acelerate the process to reduce the processing time, or a lower temperature can be used to improve the image quality or the stability of the processing solutions. Also, to save the silver of the photographic material, a process using hydrogen peroxide intensification or cobalt intensification described in West German Patent No. 2,226,770 and U.S. Pat. No. 3,674,499 may be carried out.

According to the silver halide color reversal photographic material of this invention, an excellent effect can be exhibited in forming a color reversal image of improved graininess. In particular, the silver halide color reversal photographic material of this invention can give an image high in image quality while achieving at the same time higher sensitivity and improved graininess.

Next, the present invention will be described in detail in accordance with examples, but it should be understood that these examples are not intended to limit the scope of the invention.

EXAMPLE 1

A color photographic material was prepared by multi-coatings composed of the following composition on an undercoated triacetate cellulose film base as Sample 101.

---

First layer: Antihalation layer

Gelatin layer (dry film thickness: 2 μm) comprising the following ingredients:

-continued

| | |
|---|---|
| Black colloidal silver | 0.25 g/m$^2$ |
| UV absorber U-1 | 0.04 g/m$^2$ |
| UV absorber U-2 | 0.1 g/m$^2$ |
| UV absorber U-3 | 0.1 g/m$^2$ |
| High-boiling organic solvent O-1 | 0.1 ml/m$^2$ |
| Compound A | 0.5 mg/m$^2$ |
| Second layer: Intermediate layer | |
| Gelatin layer (dry film thickness: 1 μm) comprising the following ingredients: | |
| Compound H-1 | 0.05 g/m$^2$ |
| High-boiling organic solvent O-2 | 0.05 ml/m$^2$ |
| Third layer: First red-sensitive emulsion layer | |
| Gelatin layer (dry film thickness: 1 μm) comprising the following ingredients: | |
| Silver bromoiodide monodisperse emulsion spectral-sensitized by sensitizing dyes S-1 (0.93 mg/m$^2$) and S-2 (0.04 mg/m$^2$) (iodine: 4 mol %, average grain size: 0.3 μm, grain size deviation coefficient (referred to as "deviation coefficient" hereafter): 8%) silver: | 0.33 g/m$^2$ |
| Compound B | 0.75 mg/m$^2$ |
| Coupler C-1 | 0.13 mg/m$^2$ |
| Coupler C-2 | 0.033 g/m$^2$ |
| High-boiling organic solvent O-2 | 0.08 ml/m$^2$ |
| Fourth layer: Second red-sensitive emulsion layer | |
| Gelatin layer (dry film thickness: 1.7 μm) comprising the following ingredients: | |
| Silver chlorobromide monodisperse emulsion spectral-sensitized by sensitizing dyes S-1 (1.1 mg/m$^2$) and S-2 (0.04 mg/m$^2$) (iodine: 3 mol %, average grain size: 0.5 μm, deviation coefficient: 16%) silver: | 0.53 g/m$^2$ |
| Coupler C-1 | 0.40 g/m$^2$ |
| Coupler C-2 | 0.07 g/m |
| High-boiling organic solvent O-2 | 0.22 ml/m$^2$ |
| Fifth layer: Third red-sensitive emulsion layer | |
| Gelatin layer (dry film thickness: 1.8 μm) comprising the following ingredients: | |
| Silver bromoiodide monodisperse emulsion spectral-sensitized by sensitizing dyes S-1 (1.1 mg/m$^2$) and S-2 (0.04 mg/m$^2$) (iodine: 2 mol %, average grain size: 0.6 μm, deviation coefficient: 17%) silver: | 0.53 g/m$^2$ |
| Coupler C-1 | 0.44 g/m$^2$ |
| Coupler C-2 | 0.08 g/m$^2$ |
| High-boiling organic solvent O-2 | 0.24 ml/m$^2$ |
| Sixth layer: Intermediate layer | |
| Gelatin layer (dry film thickness: 1 μm) comprising the following ingredients: | |
| Compound H-1 | 0.1 g/m$^2$ |
| High-boiling organic solvent O-1 | 0.1 ml/m$^2$ |
| Seventh layer: First green-sensitive emulsion layer | |
| Gelatin layer (dry film thickness: 0.7 μm) comprising the following ingredients: | |
| Silver chlorobromide monodisperse emulsion spectral-sensitized by sensitizing dyes S-3 (2.2 mg/m$^2$) and S-4 (1.0 mg/m$^2$) (iodine: 4 mol %, average grain size: 0.3 μm, deviation coefficient: 8%) silver: | 0.5 g/m$^2$ |
| Coupler C-6 | 0.27 g/m$^2$ |
| High-boiling organic solvent O-2 | 0.17 ml/m$^2$ |
| Eighth layer: Second green-sensitive emulsion layer | |
| Gelatin layer (dry film thickness: 1.7 μm) comprising the following ingredients: | |
| Silver bromoiodide monodisperse emulsion spectral-sensitized by sensitizing dyes S-3 (0.9 mg/m$^2$) and S-4 (0.3 mg/m$^2$) (iodine: 2.5 mol %, average grain size: 0.5 μm, deviation coefficient: 18%) silver: | 0.5 g/m$^2$ |
| Compound C | 0.80 g/m$^2$ |
| Coupler C-6 | 0.2 g/m$^2$ |
| High-boiling organic solvent O-2 | 0.13 ml/m$^2$ |
| Ninth layer: Third green-sensitive emulsion layer | |
| Gelatin layer (dry film thickness: 1.7 μm) comprising the following ingredients: | |
| Silver bromoiodide monodisperse emulsion spectral-sensitized by sensitizing dyes S-3 (0.9 mg/m$^2$) and S-4 (0.3 mg/m$^2$) (iodine: 2 mol %, average grain size: 0.6 μm, deviation coefficient: 17%) silver: | 0.5 g/m$^2$ |
| Compound C | 0.80 g/m$^2$ |
| Coupler C-4 | 0.2 g/m$^2$ |
| High-boiling organic solvent O-2 | 0.03 ml/m$^2$ |
| Tenth layer: Intermediate layer | |
| Gelatin layer (dry film thickness: 1 μm) comprising the following ingredients: | |
| Compound H-1 | 0.05 g/m$^2$ |
| High-boiling organic solvent O-2 | 0.1 ml/m$^2$ |
| Eleventh layer: Yellow filter layer | |
| Gelatin layer (dry film thickness: 1 μm) comprising the following ingredients: | |
| Yellow colloidal silver | 0.1 g/m$^2$ |
| Compound H-1 | 0.02 g/m$^2$ |
| Compound H-2 | 0.03 g/m$^2$ |
| High-boiling organic solvent O-2 | 0.04 ml/m$^2$ |
| Twelfth layer: First blue-sensitive emulsion layer | |
| Gelatin layer (dry film thickness: 1.5 μm) comprising the following ingredients: | |
| Silver chlorobromide (tabular grains) emulsion spectral-sensitized by sensitizing dye S-5 (1.0 mg/m$^2$) (iodine: 3 mol %, grains having a ratio of diameter/thickness of 7 or more are 50% in the projected area of all grains, average grain thickness: 1.0 μm) silver: | 0.6 g/m$^2$ |
| Coupler C-5 | 0.5 g/m$^2$ |
| High-boiling organic solvent O-2 | 0.5 ml/m$^2$ |
| Thirteenth layer: Second blue-sensitive emulsion layer | |
| Gelatin layer (dry film thickness: 3 μm) comprising the following ingredients: | |
| Silver iodobromide (tabular grain) emulsion spectral-sensitized by sensitizing dye S-6 (2.0 mg/m$^2$) (iodine: 2.5 mol %, grains having a ratio of diameter/thickness of 7 or more are 50% in the projected area of all grains, average grain thickness: 0.15 μm) silver: | 1.1 g/m$^2$ |
| Coupler C-5 | 1.2 g/m$^2$ |
| High-boiling organic solvent O-2 | 0.23 ml/m$^2$ |
| Fourteenth layer: First protective layer | |
| Gelatin layer (dry film thickness: 2 μm) comprising the following ingredients: | |
| UV absorber U-1 | 0.02 g/m$^2$ |
| UV absorber U-2 | 0.03 g/m$^2$ |
| UV absorber U-3 | 0.03 g/m$^2$ |
| UV absorber U-4 | 0.29 g/m$^2$ |
| High-boiling organic solvent O-1 | 0.28 ml/m$^2$ |
| Fifteenth layer: Second protective layer | |
| Gelatin layer (dry film thickness: 0.8 μm) comprising the following ingredients: | |
| Surface fogged fine-particle silver iodobromide emulsion (iodide: 1 mol %, averge grain size: 0.06 μm) silver: | 0.1 g/m$^2$ |
| Yellow colloidal silver for yellow filter layer silver: | 0.01 g/m$^2$ |
| Poly(methyl methacrylate) particles (average grain size: 1.5 μm) | |

In each layer described above, a gelatin hardener H-3 and a surface-active agent were added.

Further, in each emulsion layer compound A was added in an amount of $4\times10^{-3}$ mole per mol of silver.

Compounds used in the preparation of the sample are shown below.

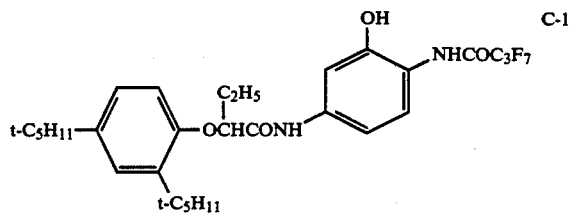

C-1

-continued
C-2
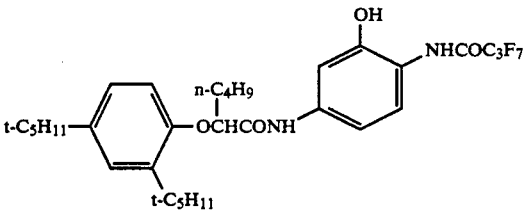
C-6
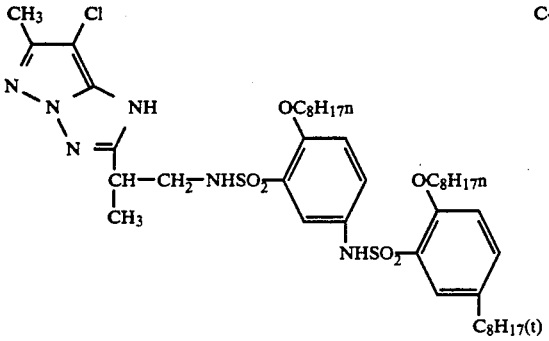
C-4
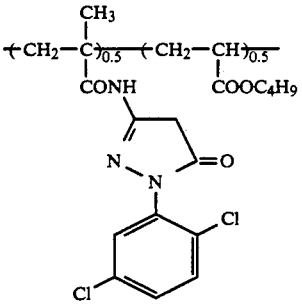
C-5
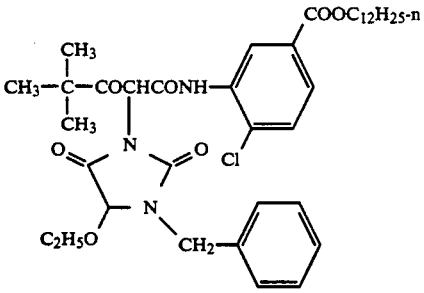
U-1
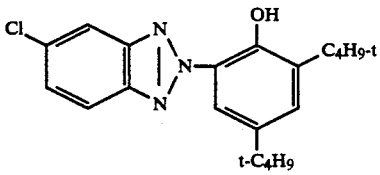
U-2
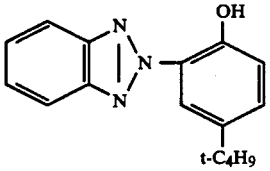
-continued
U-3
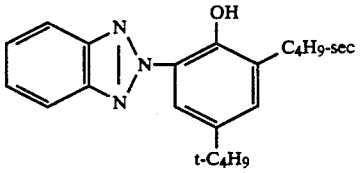
U-4
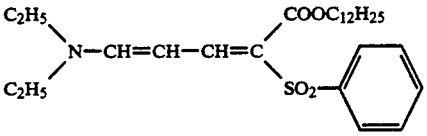
H-1
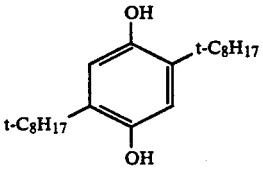
H-2
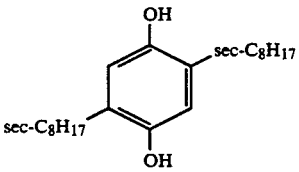
H-3
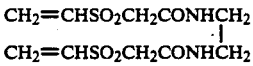
O-1
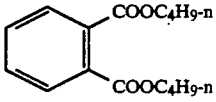
O-2
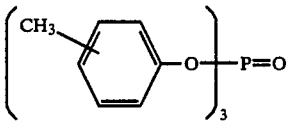
S-1
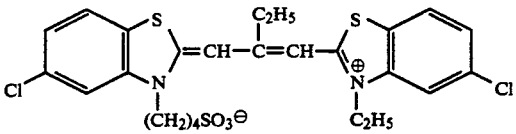
S-2
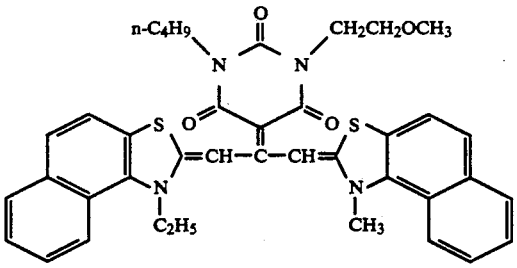
S-3
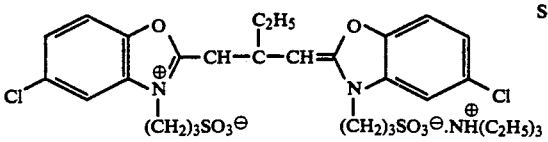

-continued

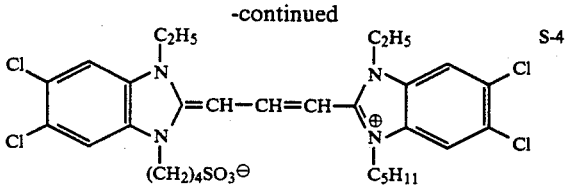

S-4

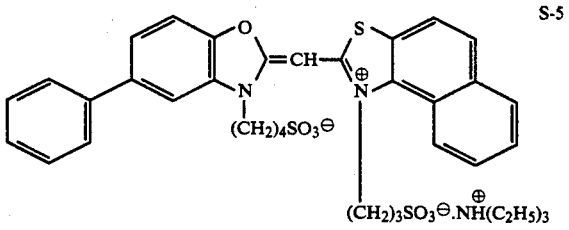

S-5

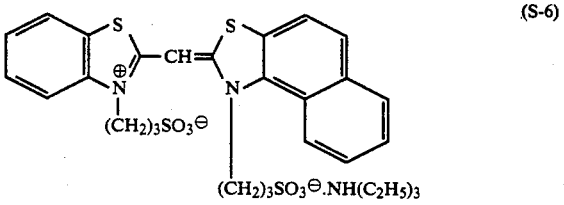

(S-6)

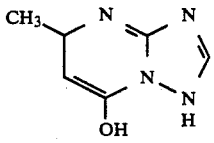

Compound A

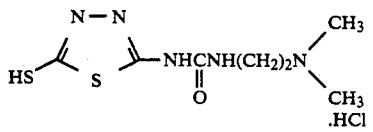

Compound B

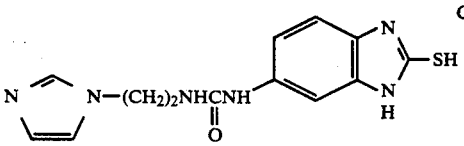

Compound C

PREPARATION OF SAMPLE 102

Sample 102 was prepared in the same manner as Sample 101, except that the content of silver iodide was 6.5 mol% in all photosensitive silver halide emulsions.

PREPARATION OF SAMPLE 103

Sample 103 was prepared in the same manner as Sample 101, except that the content of silver iodide was 7.1 mol % in all photosensitive silver halide emulsions.

PREPARATION OF SAMPLE 104

Sample 104 was prepared in the same manner as Sample 101, except that each silver iodobromide monodisperse emulsion of the 3rd, 4th, 5th, 7th, 8th, and 9th emulsion layers was changed to a polydisperse emulsion (deviation coefficient: 25%). The grain size and iodide content of which were the same as those of each layer of Sample 101.

PREPARATION OF SAMPLE 105

Sample 105 was prepared in the same manner as Sample 101, except that each emulsion of the 3rd and 7th layers was changed to a mixed emulsion of two emulsions, one of which had an iodide content of 4 mol %, an average grain size of 0.3 μm, and a deviation coefficient of 19%, and other of which had an iodide content of 4 mol%, an average grain size of 0.1 μm, and a deviation coefficient of 6%, in a ratio of 3:1 in terms of silver. This mixed emulsion had two maximums in its grain size distribution curve and the difference of grain sizes between the two maximums was 0.20 μm.

PREPARATION OF SAMPLE 106

Sample 106 was prepared in the same manner as Sample 102, except that each emulsion of the 3rd and 7th layers was changed to a mixed emulsion of two emulsions, one of which was the same as the emulsion of the 3rd and 7th layers, respectively, and the other of which had an iodide content of 6.5 mol %, an average grain size of 0.1 m, and a deviation coefficient of 6%, in a ratio of 3:1 in terms of silver, so as to have the same total amount of silver in each layer as in Sample 2. This mixed emulsion had two maximums in its grain size distribution curve, and the difference of grain sizes between the two maximums was 0.18 μm.

PREPARATION OF SAMPLE 107

Sample 107 was prepared in the same manner as Sample 101, except that each emulsion of the 3rd to the 5th, the 7th to the 9th, the 12th and the 13th layers was changed to a mixed emulsion of emulsions A and B as described in Table 1 in which the iodide content and coating amount of silver were the same as in Sample 101.

TABLE 1

| | Emulsion A | | Emulsion B | | Mixing | Difference |
|---|---|---|---|---|---|---|
| Layer | Average Grain Size | Deviation Coefficient | Average Grain Size | Deviation Coefficient | Ratio A:B | between two Maximums |
| 3rd | 0.3 μm | 8% | 0.1 μm | 6% | 3:1 | 0.20 μm |
| 4th | 0.5 μm | 16% | 0.2 μm | 12% | 3:1 | 0.29 μm |
| 5th | 0.6 μm | 17% | 0.2 μm | 12% | 2:1 | 0.38 μm |
| 7th | 0.3 μm | 8% | 0.1 μm | 10% | 4:1 | 0.20 μm |
| 8th | 0.5 μm | 18% | 0.2 μm | 12% | 4:1 | 0.28 μm |
| 9th | 0.6 μm | 17% | 0.3 μm | 19% | 3:1 | 0.28 μm |
| 12th | Grains having an Aspect Ratio of 7 or more are 50% in Projected Area. Average Grain Thickness: 0.1 μm | | 0.2 μm | 12% | 4:1 | 0.22 μm |
| 13th | Grains having an Aspect Ratio of 7 or more are 50% in Projected Area. Average Grain Thickness: 0.15 μm | | 0.3 μm | 19% | 5:1 | 0.35 μm |

PREPARATION OF SAMPLE 108

Sample 108 was prepared in the same manner as Sample 101, except that each emulsion of the 3rd and 7th layers was changed to a mixed emulsion in which an emulsion having an iodide content of 7.1 mol %, an average grain size of 0.1 μm, and a deviation coefficient of 8% was added to each emulsion of the 3rd and 7th layers of Sample 103 in a ratio of 3:1, so as to have the same total amount of silver in each layer as in Sample 103. This mixed emulsion for the 3rd and 7th layers had two maximums in its grain size distribution curve and the difference of grain sizes between the two maximums was 0.18 μm.

PREPARATION OF SAMPLE 109

Sample 109 was prepared in the same manner as Sample 101, except that each emulsion of the 3rd and 7th layers was changed to a mixed emulsion in which an emulsion having an iodide content of 4 mol %, an average grain size of 0.1 μm, and a deviation coefficient of 6% was added to each emulsion of the 3rd and 7th layers of Sample 103 in a ratio of 1:1, so as to have the same total amount of silver in each layer as in Sample 104. This mixed emulsion for the 3rd and 7th layers had two maximums in its grain size distribution curve and the difference of grain sizes between the two maximums was 0.19 μm.

PREPARATION OF SAMPLE 110

Sample 110 was prepared in the same manner as Sample 105, except that an emulsion having an average grain size of 0.21 μm and a deviation coefficient of 6% was used for the 3rd and 7th layers instead of the emulsion having an average grain size of 0.1 μm and a deviation coefficient of 6%. This mixed emulsion for the 3rd and 7th layers had two maximums in its grain size distribution curve and the difference of grain sizes between the two maximums was 0.08 μm.

PREPARATION OF SAMPLES 111 to 119

Samples 111 to 119 were prepared in the same manner as Samples 101 to 104, 108, 110, 105, 106, and 109, respectively, except that the compound I-11 was added in the 3rd and 7th layers in an amount of $1\times10^{-4}$ mol per mol of silver in each emulsion of the layers.

PREPARATION OF SAMPLES 120 to 127

Samples 120 to 127 were prepared in the same manner as Sample 107, except that each of compounds I-13, I-1, I-4, I-8, I-9, I-12, I-18, and I-29 was added in the 3rd to the 5th, the 7th to the 9th, and the 12th and 13th layers, respectively, in an amount of $1\times10^{-4}$ mol per mol of silver in each emulsion of the layers.

PREPARATION OF SAMPLE 128

Sample 128 was prepared by the same manner as Sample 107, except that the compound I-23 was added in the 2nd, 6th, 10th, 11th, and 14th layers so as to be a coating amount of $2\times10^{-6}$ mol m , respectively.

These samples 102 to 128 were subjected to an exposure of a white light from a light source of 5400K through a continuous wedge, and then to a development processing according to the following steps.

| Step | Time | Temperature |
|---|---|---|
| First developing | 6 min. | 38° C. |

-continued

| Step | Time | Temperature |
|---|---|---|
| Water washing | 2 min. | 38° C. |
| Reversal | 2 min. | 38° C. |
| Color development | 6 min. | 38° C. |
| Conditioning | 2 min. | 38° C. |
| Bleaching | 6 min. | 38° C. |
| Fixing | 4 min. | 38° C. |
| Water washing | 4 min. | 38° C. |
| Stabilizing | 1 min. | 25° C. |

The composition of each processing solution was as follows:

| First developing solution | |
|---|---|
| Pentasodium nitrilo-N,N,N-trimethylene phosphonate | 2.0 g |
| Sodium sulfite | 30 g |
| Potassium hydroquinone.monosulfonate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

The pH was adjusted by hydrochloric acid or potassium hydroxide.

| Reversal solution | |
|---|---|
| Pentasodium nitrilo-N,N,N-trimethylene phosphonate | 3.0 g |
| Stannous chloride.$2H_2O$ | 1.0 g |
| p-Aminophenol | 0.1 g |
| Sodium hydroxide | 8 g |
| Glacial acetic acid | 15 ml |
| Water to make | 1000 ml |
| pH | 6.00 |

The pH was adjusted by hydrochloric acid or sodium hydroxide.

| Color-developing solution | |
|---|---|
| Pentasodium nitrilo-N,N,N-trimethylene phosphonate | 2.0 g |
| Sodium sulfite | 7.0 g |
| Trisodium phosphate.$12H_2O$ | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1.0 g |
| Water to make | 1000 ml |
| pH | 11.80 |

The pH was adjusted by hydrochloric acid or potassium hydroxide.

| Conditioning solution | |
|---|---|
| Disodium ethylenediaminetetra-acetate.$2H_2O$ | 8.0 g |
| Sodium sulfite | 12 g |
| 1-Thioglycerol | 0.4 ml |
| Water to make | 1000 ml |
| pH | 6.20 |

The pH was adjusted by hydrochloric acid or sodium hydroxide.

The graininess is indicated by the value of 1000 times RMS graininess.

TABLE 2

| Sample | Cyan | | | Magenta | | | Yellow | | |
|---|---|---|---|---|---|---|---|---|---|
| | Max. Density | Relative Sensitivity | Grain-iness | Max. Density | Relative Sensitivity | Grain-iness | Max. Density | Relative Sensitivity | Grain-iness |
| 101 (Comparative Example) | 2.85 | 100 | 18.8 | 3.12 | 100 | 19.2 | 3.15 | 100 | 28.5 |
| 102 (Comparative Example) | 2.87 | 97 | 18.7 | 3.15 | 96 | 19.1 | 3.19 | 97 | 28.3 |
| 103 (Comparative Example) | 2.89 | 95 | 18.7 | 3.17 | 95 | 19.1 | 3.21 | 95 | 28.3 |
| 104 (Comparative Example) | 2.81 | 95 | 19.0 | 3.10 | 94 | 19.4 | 3.10 | 94 | 28.7 |
| 105 (Comparative Example) | 2.91 | 80 | 16.4 | 3.19 | 81 | 16.9 | 3.15 | 99 | 28.5 |
| 106 (Comparative Example) | 2.92 | 78 | 16.3 | 3.21 | 79 | 16.8 | 3.14 | 100 | 28.5 |
| 107 (Comparative Example) | 2.95 | 72 | 15.5 | 3.24 | 71 | 16.1 | 3.21 | 69 | 26.1 |
| 108 (Comparative Example) | 2.91 | 59 | 16.2 | 3.23 | 62 | 16.7 | 3.15 | 99 | 28.5 |
| 109 (Comparative Example) | 2.84 | 75 | 16.7 | 3.17 | 76 | 17.3 | 3.14 | 99 | 28.5 |
| 110 (Comparative Example) | 2.85 | 88 | 18.2 | 3.14 | 89 | 18.6 | 3.15 | 100 | 28.5 |
| 111 (Comparative Example) | 2.81 | 127 | 19.4 | 3.10 | 124 | 20.0 | 3.12 | 102 | 28.6 |
| 112 (Comparative Example) | 2.83 | 121 | 19.3 | 3.11 | 120 | 19.9 | 3.11 | 103 | 28.6 |
| 113 (Comparative Example) | 2.83 | 108 | 19.1 | 3.12 | 107 | 19.7 | 3.14 | 101 | 28.6 |
| 114 (Comparative Example) | 2.79 | 122 | 19.6 | 3.08 | 121 | 20.2 | 3.14 | 101 | 28.5 |
| 115 (Comparative Example) | 2.87 | 89 | 16.6 | 3.18 | 77 | 17.0 | 3.13 | 103 | 28.6 |
| 116 (Comparative Example) | 2.81 | 104 | 18.4 | 3.11 | 105 | 18.9 | 3.13 | 104 | 28.7 |
| 117 (This Invention) | 2.88 | 132 | 16.7 | 3.17 | 133 | 17.2 | 3.13 | 103 | 28.6 |
| 118 (This Invention) | 2.89 | 129 | 16.6 | 3.20 | 131 | 17.1 | 3.14 | 104 | 28.6 |
| 119 (This Invention) | 2.81 | 125 | 16.9 | 3.15 | 128 | 17.4 | 3.13 | 103 | 28.5 |
| 120 (This Invention) | 2.91 | 132 | 15.7 | 3.21 | 132 | 16.4 | 3.19 | 122 | 26.8 |
| 121 (This Invention) | 2.88 | 132 | 15.8 | 3.19 | 130 | 16.5 | 3.15 | 124 | 26.9 |
| 122 (This Invention) | 2.90 | 128 | 15.6 | 3.20 | 127 | 16.4 | 3.17 | 120 | 26.8 |
| 123 (This Invention) | 2.88 | 131 | 15.7 | 3.20 | 128 | 16.5 | 3.16 | 122 | 26.9 |
| 124 (This Invention) | 2.88 | 125 | 15.7 | 3.20 | 124 | 16.5 | 3.17 | 119 | 26.9 |
| 125 (This Invention) | 2.82 | 139 | 16.0 | 3.15 | 140 | 16.9 | 3.11 | 129 | 27.3 |
| 126 (This Invention) | 2.88 | 130 | 15.7 | 3.18 | 126 | 16.4 | 3.15 | 122 | 26.9 |
| 127 (This Invention) | 2.88 | 133 | 15.7 | 3.19 | 135 | 16.6 | 3.15 | 127 | 26.9 |
| 128 (This Invention) | 2.95 | 119 | 16.5 | 3.21 | 121 | 17.1 | 3.13 | 105 | 28.7 |

| Bleaching solution | |
|---|---|
| Disodium ethylenediaminetetra-acetate.$2H_2O$ | 2.0 g |
| Iron (III) ammonium ethylenediamine-tetraacetate.$2H_2O$ | 120 g |
| Potassium bromide | 100 g |
| Ammonium nitrate | 10 g |
| Water to make | 1000 ml |
| pH | 5.70 |

The pH was adjusted by hydrochloric acid or sodium hydroxide.

| Fixing solution | |
|---|---|
| Sodium thiosulfite | 80 g |
| Sodium sulfite | 5.0 g |
| Sodium bisulfite | 5.0 g |
| Water to make | 1000 ml |
| pH | 6.60 |

The pH was adjusted by hydrochloric acid or aqueous ammonia.

| Stabilizing solution | |
|---|---|
| Formalin (37%) | 5.0 ml |
| Polyoxyethylene-p-monononylphenyl ether (average polymerization degree: 10) | 0.5 ml |
| Water to make | 1000 ml |
| pH | not adjusted |

Each of the above development processed samples was subjected to measurement of densities of cyan, magenta, and yellow, to obtain the maximum density and relative sensitivity at a density of 1.0, and graininess. The results are shown in Table 2.

From the results shown in Table 2, it is apparent that the present invention is excellent compared with the comparative samples in the following points:

(1) higher sensitivity and better graininess compared with not using a mixed emulsion (Sample 111 vs. Sample 117), (2) particularly higher sensitivity and almost no occurrence of graininess deterioration compared with not containing the compound releasing FA (FR compound) (Sample 105 vs. Sample 117), (3) particularly higher sensitivity and almost no occurrence of graininess deterioration compared with when the average content of silver iodide in the photographic silver halide emulsion layer is 7 mol % or over (Sample 115 vs. Samples 117 and 118), (4) higher sensitivity and better graininess compared with when the difference between the two maximums of the grain distribution curve is below 0.1 μm (Sample 116 vs. Sample 117).

EXAMPLE 2

Samples 101 to 128 of Example 1 were subjected to the same exposure in Example 1 and to the development processing as described below. The same results as in Example 1 were obtained.

| Step | Time | Temperature |
|---|---|---|
| First developing | 6 min. | 38° C. |
| First water washing | 45 sec. | 38° C. |
| Reversal | 45 sec. | 38° C. |
| Color developing | 6 min. | 38° C. |
| Bleaching | 2 min. | 38° C. |
| Bleach-fixing | 4 min. | 38° C. |
| Second water washing (1) | 1 min. | 38° C. |
| Second water washing (2) | 1 min. | 38° C. |

-continued

| Step | Time | Temperature |
|---|---|---|
| Stabilizing | 1 min. | 25° C. |

The composition of each processing solution was as follows:

| | |
|---|---|
| First developing solution | |
| The same as in Example 1 | |
| First water-washing solution | Mother solution |
| Ethylenediaminetetramethylene phosphonate | 2.0 g |
| Disodium phosphate | 5.0 g |
| Water to make | 1000 ml |
| pH | 7.00 |

The pH was adjusted by hydrochloric acid or sodium hydroxide.

| | |
|---|---|
| Reversal solution | |
| The same as in Example 1 | |
| Color-developing solution | |
| The same as in Example 1 | |
| Bleaching solution | |
| Disodium ethylenediaminetetra-acetate.$2H_2O$ | 10.0 g |
| Iron (III) ammonium ethylenediamine-tetraacetate.$2H_2O$ | 120 g |
| Ammonium bromide | 100 g |
| Ammonium nitrate | 10 g |
| Bleach accelerator | 0.005 mol |

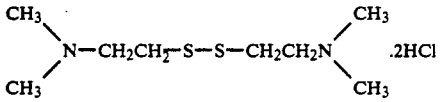

| | |
|---|---|
| Water to make | 1000 ml |
| pH | 6.30 |

The pH was adjusted by hydrochloric acid or aqueous ammonia.

| Bleach-fixing solution | |
|---|---|
| Iron (III) ammonium ethylenediamine-tetraacetate.$2H_2O$ | 50 g |
| Disodium ethylenediaminetetra-acetate.$2H_2O$ | 5.0 g |
| Ammonium thiosulfate | 80 g |
| Sodium bisulfite | 12.0 g |
| Water to make | 1000 ml |
| pH | 6.60 |

The pH was adjusted by hydrochloric acid or aqueous ammonia.

Second water-washing solution

Tap water was treated by passage through a hybrid-type column filled with an H-type strong acidic cation-exchange resin (Amberlite IR-120, made by Rhom & Haas Co.) and an OH-type strong alkaline anion-exchange resin (Amberlite IR-400, same maker as above), to obtain water in which the concentrations of Ca and Mg ions were 3 mg/l. Then, to the thus-treated water, 20 mg/l of sodium dichloroisocyanurate and 1.5 g/l of sodium sulfate were added. The pH of this solution was in the range of 6.5 to 7.5.

Stabilizing solution

The same as in Example 1.

EXAMPLE 3

Preparation of Sample 301

Sample 301 was prepared in the same manner as Sample 101, except that the emulsions of the 3rd layer and the 7th layer were changed to mixed emulsions as described in the following Table 3.

TABLE 3

| | | 3rd layer | 7th layer |
|---|---|---|---|
| Emulsion A | Average grain size | 0.37 μm | 0.40 μm |
| | Deviation coefficient | 10% | 12% |
| Emulsion B | Average grain size | 0.25 μm | 0.25 μm |
| | Deviation coefficient | 8% | 7% |
| Emulsion C | Average grain size | 0.10 μm | 0.11 μm |
| | Deviation coefficient | 7% | 7% |
| Mixture ratio (A:B:C) | | 1:1:1 | 1:1:1 |
| Difference between two maximums of grain size distribution curve at the smallest side of grain diameter. | | 0.14 μm | 0.13 μm |

Preparation of Sample 302

Sample 302 was prepared in the same manner as Sample 301, except that compound I-11 was added to the emulsions of the 3rd and 7th layers, respectively, in an amount of $1\times10^{-4}$ mol per mol of silver The thus-prepared Samples 101, 111, 301, and 302 were subjected to an exposure of light and then to development processing as in Example 1, and their density, relative sensitivity, and graininess were tested. The results are shown in Table 4.

TABLE 4

| | Cyan | | | Magenta | | |
|---|---|---|---|---|---|---|
| Sample | MD | RS | GR | MD | RS | GR |
| 101 (Comparative Example) | 2.85 | 100 | 18.8 | 3.12 | 100 | 19.2 |
| 111 (Comparative Example) | 2.81 | 127 | 19.4 | 3.10 | 124 | 20.0 |
| 301 (Comparative Example) | 2.88 | 91 | 16.4 | 3.16 | 88 | 16.7 |
| 302 (This Invention) | 2.85 | 132 | 16.6 | 3.14 | 129 | 16.9 |

Note:
MD: Max. Density, RS: Relative Sensitivity, GR: Graininess

As is apparent from the results in Table 4, this invention is excellent in sensitivity and graininess compared with the comparative example.

EXAMPLE 4

Preparation of Samples 401 to 410

Samples 401 to 410 were prepared in the same manner as Sample 120, except that the compound shown in the composition of the 5th layer was added to each of the 3rd, 4th, 5th, 7th, 8th, 9th, 12th, and 13th layers in an amount of $1\times10^{-3}$ mol per mol of silver, respectively.

The thus-prepared Samples 401 to 410 were each divided into 2 groups, with one group kept at room temperature and the other at 45° C., 50% RH, for 7 days. These samples were subjected to a light exposure through a wedge for sensitometry and then to the same development processing as in Example 1. The densities of cyan, magenta, and yellow were measured.

The differences of light exposure (Δlog E) to attain a density of 1.0 between the groups of samples, one of which was kept at 45° C., 50% RH for 7 days and the other of which was kept at room temperature for 7 days, and the differences in maximum density ($\Delta D_{max}$) are shown in Table 5.

The larger the value of Δlog E, the larger the sensitization in storage at high temperature, and the larger the value of $\Delta D_{max}$, the larger the lowering of maximum density in storage at high temperature, both of which are not preferable.

TABLE 5

| Sample No. | Added Compound | Cyan Δ log E | Cyan $\Delta D_{max}$ | Magenta Δ log E | Magenta $\Delta D_{max}$ | Yellow Δ log E | Yellow $\Delta D_{max}$ |
|---|---|---|---|---|---|---|---|
| 120 (Comparative Example) | — | 0.13 | 0.23 | 0.12 | 0.19 | 0.12 | 0.18 |
| 401 (This Invention) | II-27 | 0.03 | 0.05 | 0.03 | 0.04 | 0.04 | 0.05 |
| 402 (This Invention) | II-38 | 0.02 | 0.02 | 0.03 | 0.05 | 0.03 | 0.04 |
| 403 (This Invention) | II-41 | 0.01 | 0.05 | 0.01 | 0.02 | 0.02 | 0.03 |
| 404 (This Invention) | II-49 | 0.02 | 0.03 | 0.02 | 0.04 | 0.02 | 0.04 |
| 405 (This Invention) | II-16 | 0.03 | 0.04 | 0.02 | 0.04 | 0.03 | 0.05 |
| 406 (This Invention) | III-12 | 0.04 | 0.06 | 0.04 | 0.07 | 0.05 | 0.07 |
| 407 (This Invention) | III-16 | 0.04 | 0.08 | 0.05 | 0.08 | 0.05 | 0.08 |
| 408 (This Invention) | IV-1 | 0.02 | 0.04 | 0.03 | 0.04 | 0.04 | 0.06 |
| 409 (This Invention) | V-3 | 0.07 | 0.11 | 0.07 | 0.09 | 0.08 | 0.10 |
| 410 (This Invention) | VI-11 | 0.05 | 0.08 | 0.06 | 0.07 | 0.06 | 0.09 |

As is apparent from the results in Table 5, the sensitization and lowering of maximum density due to storage at high temperature are less in the present invention compared with the comparative example.

Having described our invention as related to the embodiment, it is our intention that the invention not be limited by any of the details of the description, unless otherwise specified, but rather be construed broadly within its spirit and scope as set out in the accompanying claims.

What we claim is:

1. A silver halide color reversal photographic material comprising photosensitive silver halide photographic layers formed on a base in which:

(i) the average silver iodide content of the photosensitive silver halide emulsion in each of said photosensitive silver halide photographic layers formed on a base is less than 7.0 mol %, at least one emulsion layer of said photographic layers comprises two or more emulsions having different average grain diameters in the range of 0.05 and 3.0 μm, (ii) the grain diameter distribution curve of the silver halide grains of said at least one emulsion layer of said photographic layers has two or more local maximums, and the grain diameter difference of the lowest local maximum and the next lowest local maximum is 0.1 μm or over, and (iii) said at lest one emulsion layer of (i) and/or an adjacent intermediate layer contains at least one compound that can release a fogging agent, a development accelerator, or their precursor, corresponding to the developed silver quantity by a redox reaction with the oxidation product of a developing agent, or by a reaction subsequent to such redox reaction, wherein the compound that can release a fogging agent, a development accelerator, or their precursor is represented by formula (I):

*RED—(TIME)$_n$—FA* *Formula (I)* wherein

RED represents a residue able to cause a redox reaction with the oxidation product of a developing agent, —(TIME)$_n$—FA is linked to a position where it can be released from RED by a redox reaction with the oxidation product of a developing agent, or by a reaction subsequent to such redox reaction, TIME represents a timing group that splits off from RED by a coupling reaction and then release FA, n is 0 or 1, FA is a group that can split off from RED by a coupling reaction when n is 0, or a group that can be released from TIME when n is 1, and FA is a development accelerator or a fogging agent that can act on silver halide grains at the time of the developing process to produce fogging nuclei capable of starting the development and FA is selected from groups represented by the following formulas (VIIIa) and (IXa):

Formula (VIIIa)

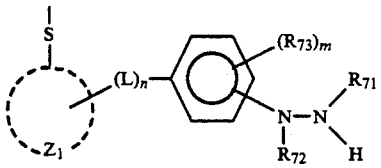

Formula (IXa)

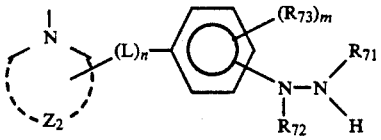

wherein $R_{71}$ represents an acyl group, a carbamoyl group, an alkylsulfonyl group, an arylsulfonyl group, an alkoxycarbonyl group, an aryloxycarbonyl group, or a sulfamoyl group;

$R_{72}$ represents a hydrogen atom, an acyl group, an alkoxycarbonyl group, an alkylsulfonyl group, an arylsulfonyl group, or an aryloxycarbonyl group;

$R_{73}$ represents a halogen atom, an alkoxy group, an alkyl group, an alkenyl group, an aryl group, an aryloxy group, an alkylthio group, an arylthio group, a carbonamido group, or a sulfonamido group;

m is an integer of 0 to 4; when m is 2 or over, $R_{73}$'s may be the same or different, and two or more $R_{73}$'s may be bonded to form a condensed ring;

L represents a divalent linking group;

n is 0 or 1;

$Z_1$ represents a group of nonmetallic atoms required for forming a monocyclic or condensed heterocyclic ring; and $Z_2$ represents a group of nonmetallic atoms required for forming together with N a monocyclic or condensed heterocyclic ring.

2. The silver halide color reversal photographic material as claimed in claim 1, wherein the average silver iodide content in each of said photosensitive silver halide photographic layers is in the range of 1.0 to 6.5 mol %.

3. The silver halide color reversal photographic material as claimed in claim 1, wherein the average silver iodide content in each of said photosensitive silver halide photographic layers is in the range of 1.5 to 6.0 mol %.

4. The silver halide color reversal photographic material as claimed in claim 1, wherein each emulsion having different average grain diameters in the range of 0.05 to 3.0 μm comprises at least one monodisperse silver halide emulsion.

5. The silver halide color reversal photographic material as claimed in claim 4, wherein one of the monodisperse silver halide emulsion is an emulsion having the smallest average grain diameter.

6. The silver halide color reversal photographic material as claimed in claim 4, wherein the at least one emulsion layer of (i) comprises monodisperse silver halide emulsions having different average grain diameters.

7. The silver halide color reversal photographic material as claimed in claim 1, wherein the emulsions having different average grain diameters are in the range of 0.1 to 2.5 μm.

8. The silver halide color reversal photographic material as claimed in claim 1, wherein the emulsions having different average grain diameters are in the range of 0.15 to 2.0 μm.

9. The silver halide color reversal photographic material as claimed in claim 1, wherein the grain diameter difference between the lowest local maximum and the next lowest local maximum is in the range of 0.15 to 1.0 μm.

10. The silver halide color reversal photographic material as claimed in claim 1, wherein RED is a group that has a skeleton of hydroquinone, catechol, o-aminophenol, or p-aminophenol, undergoes a redox reaction with the oxidation product of a developing agent and then undergoes an alkaline hydrolysis to release a group —$(TIME)_n$—FA.

11. The silver halide color reversal photographic material as claimed in claim 1, wherein RED—$(TIME)_n$—FA is represented by the following formulae (IIa) to (VIIIa):

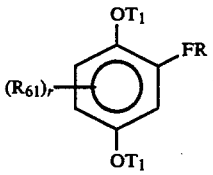

(IIa)

-continued

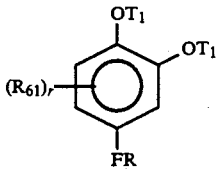

(IIIa)

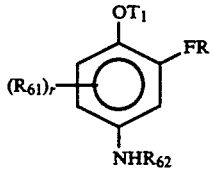

(IVa)

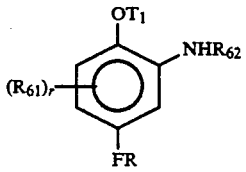

(Va)

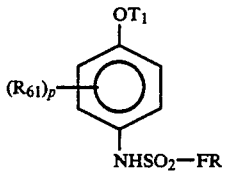

(VIa)

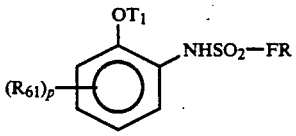

(VIIa)

wherein $R_{61}$ represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxy group, a sulfo group, a sulfonyl group, an acyl group, a carbonamide group, a sulfonamide group, a hydroxy group, an acyloxy group, or a heterocyclic group; r is an integer of 1 to 3 ; p is an integer of 1 to 4, when p or r is 2 or over; $R_{61}$'s may be the same or different, or they may form a benzene ring or a 5- to 7-membered heterocyclic ring by linking the two of them located in the vic-positions; $R_{62}$ represents an alkyl group, an aryl group, an acyl group, a carbamoyl group, a sulfonyl group, or a sulfamoyl group; $T_1$ represents a hydrogen atom or a group that can split when hydrolyzed under alkaline conditions, and when there are two $T_1$'s in the molecule they may be different from each other wherein FR represents $(TIME)_n$—FA.

12. The silver halide color reversal photographic material as claimed in claim 1, wherein a compound selected from the group consisting of compounds represented by the following formulae (II), (III), (IV), (V), and (VI) is used in combination with the compound represented by formula (I):

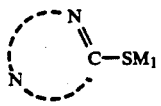

Formula (II)

wherein $M_1$ represents a hydrogen atom, a cation, or a protective group for the mercapto group that can be split off with an alkali, and Z represents a group of atoms required to form a 5- to 6-membered heterocyclic ring;

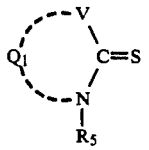

Formula (III)

wherein $R_5$ represents a hydrogen atom or a substituted or unsubstituted alkyl, aralkyl, alkenyl, or aryl group, or heterocyclic residue; V represents O, S, Se, or $NR_6$, in which $R_6$ represents an alkyl group, an aralkyl group, an alkenyl group, an aryl group, or a heterocyclic ring residue; $R_6$ and $R_5$ may be the same or different; and $Q_1$ represents a group of atoms required to form a 5- to 6-membered heteroxyclic ring, which may be condensed;

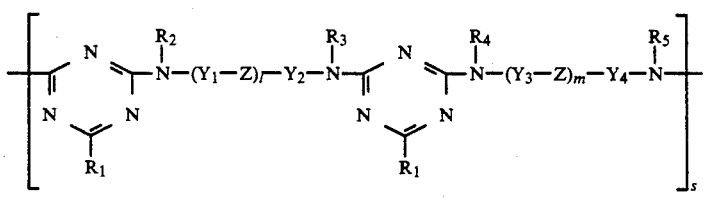

Formula (IV)

wherein $R_1$ represents —OR, —SR,

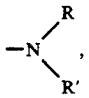

in which R and R' and represent a hydrogen atom, an alkyl group, a hydroxyalkyl group, a sulfoalkyl (or its salt) group, a carboxylalkyl (or its salt) group, an aralkyl group, an aryl group that may have a sulfo (or its salt), carboxy (or its salt), alkyl, alkoxy or halogen substituent, or a cycloalkyl group, or R and R' may together form an alkylene ring that may include —O—, $R_2$, $R_3$, $R_4$, and $R_5$, where each represents a hydrogen atom or an alkyl group; $Y_1$, $Y_2$, $Y_3$, and $Y_4$ each represent a polymethylene group that may be substituted by an alkyl group, an allylen group that may have a sulfo (or its salt), carboxyl (or its salt), alkyl or halogen substituent, or a cycloalkylene group; Z represents —O—, $—SO_2—$, or $—CH_2—$, l and m each are 0 or 1; and s is 2 to 100;

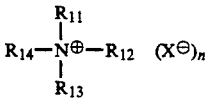

Formula (V)

wherein $R_{11}$ to $R_{14}$ each represent an alkyl group, an aryl group, or an aralkyl group; $R_{11}$, $R_{12}$, and $R_{13}$ may together form a heterocyclic ring, including quaternary nitrogen; X represents an anion; and n is 1, except that when the compound forms an inner salt, n is 0;

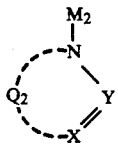

Formula (VI)

wherein Y and Z each independently represent methine, substituted methine, or a nitrogen atom, $Q_2$ represents a group of atoms required to form a 5- or 6-membered heterocylic ring, which may be condensed, and $M_2$ represents a hydrogen atom or a cation such as an alkali metal cation and an ammonium ion.

13. The silver halide color reversal photographic material as claimed in claim 1, wherein the amount of the compound contained in the emulsion layer and/or the adjacent intermediate layer is $10^{-9}$ to $10^{-1}$ mol per mol of silver of the silver halide contained in the layer.

14. The silver halide color reversal photographic material as claimed in claim 1, wherein the amount of the compound contained in the emulsion layer and/or the adjacent intermediate layer is $10^{-6}$ to $10^{-1}$ mol per mol of silver of the silver halide contained in the layer.

15. The silver halide color reversal photographic material as claimed in claim 1, wherein the amount of the compound contained in the emulsion layer and/or the adjacent intermediate layer is $10^{-5}$ to $10^{-2}$ mol per mol of silver of the silver halide contained in the layer.

* * * * *